United States Patent [19]

Kume et al.

[11] Patent Number: 5,027,161

[45] Date of Patent: Jun. 25, 1991

[54] IMAGE FORMING APPARATUS

[75] Inventors: Nobuyuki Kume; Masanori Miyata, both of Yokohama; Nobuo Nakazawa, Kawasaki, all of Japan

[73] Assignee: Canon Kabushiki Kaisha, Tokyo, Japan

[21] Appl. No.: 405,577

[22] Filed: Sep. 8, 1989

Related U.S. Application Data

[63] Continuation of Ser. No. 245,377, Sep. 16, 1988, abandoned.

[30] Foreign Application Priority Data

Sep. 17, 1987 [JP] Japan ..... 62-233337
Nov. 13, 1987 [JP] Japan ..... 62-287919

[51] Int. Cl.[5] ..... G03G 21/00

[52] U.S. Cl. ..... 355/305; 355/297; 118/652

[58] Field of Search ..... 355/305, 296, 297, 328; 118/652; 15/256.51, 256.52

[56] References Cited

U.S. PATENT DOCUMENTS 4,154,522 5/1979 Ikesue ..... 355/305 X
4,263,390 4/1981 Yamashita et al. ..... 355/305 X
4,436,412 3/1984 Yamagata et al. ..... 355/305
4,552,451 11/1985 Yamazaki et al. ..... 355/305

FOREIGN PATENT DOCUMENTS 58-115764 3/1983 Japan .
62-131283 6/1987 Japan .
62-163081 7/1987 Japan .

*Primary Examiner*—R. L. Moses
*Attorney, Agent, or Firm*—Fitzpatrick, Cella, Harper & Scinto

[57] ABSTRACT

An image forming apparatus includes a movable image bearing member, a latent image forming device for forming a latent image on the image bearing member, a developing device for developing the latent image formed on the image bearing member by the latent image forming device with non-magnetic toner, a transfer device for transferring an image developed by the developing device to a transfer device, a cleaning device for removing residual toner from the image bearing member after the image is transferred wherein the cleaning device includes magnetic paricle retaining device for retaining magnetic particles and a magnetic particle supplying device for supplying the magnetic particles to the magnetic particle retaining device of the cleaning device.

43 Claims, 19 Drawing Sheets

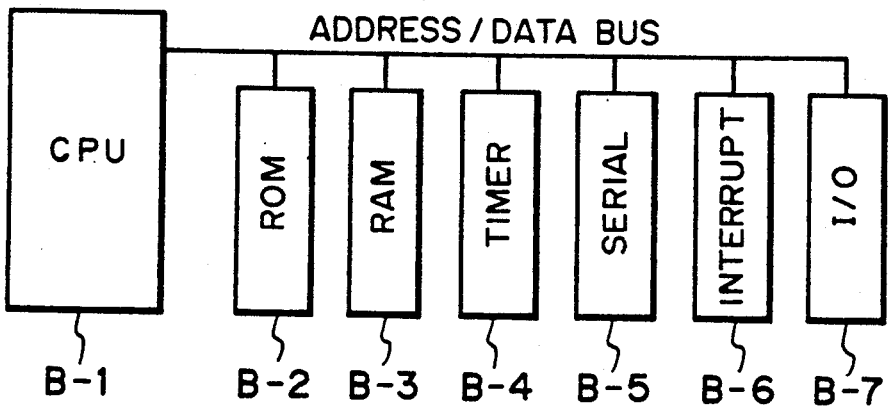
FIG. 11
FIG. 12(a)
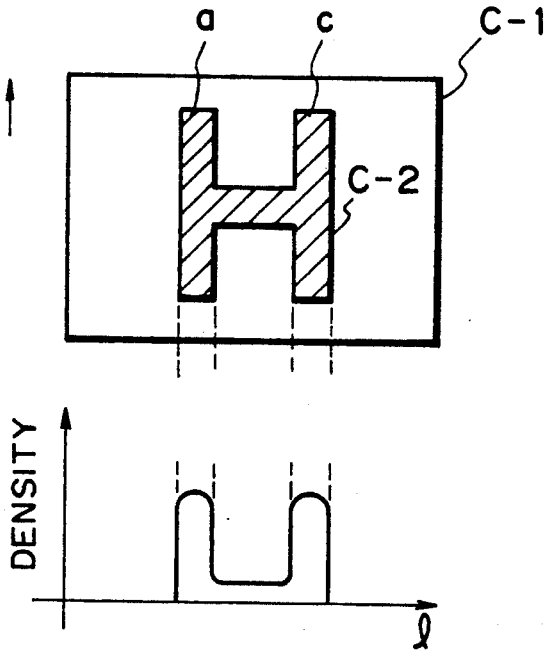
FIG. 12(b)

IMAGE FORMING APPARATUS

This application is a continuation of application Ser. No. 245,377 filed Sept. 16, 1988, now abandoned.

FIELD OF THE INVENTION AND RELATED ART

The present invention relates to an image forming apparatus capable of forming, for example, two-color or multi-color images by development with non-magnetic toner, and more particularly to a cleaning device for removing the non-magnetic toner remaining on an image bearing member after the image formation.

In an image forming apparatus such as an electrophotographic copying apparatus or the like, a toner image formed on an electrophotographic photosensitive member surface is transferred onto a transfer sheet of paper or the like to produce a copy. The photosensitive member, after the image is transferred therefrom, is cleaned by removing the toner remaining on the surface of the photosensitive member by cleaning means in one form or another, so that the photosensitive member can be used for repeated image forming process.

As for the cleaning means for this purpose, a cleaning blade made of elastic material such as urethane rubber or the like is generally used, since the structure thereof is simple and compact and also since it is good in the toner removing performance.

Although the cleaning blade is good in the toner removing function, it is not sufficient for removal of rosin and talc or other deposit produced from a transfer sheet or paper which is most frequently used as the transfer material and for removal of productions of corona discharge from a high voltage member in the apparatus. Once those materials are deposited on the surface of the photosensitive member, the image is disturbed under high humidity conditions to deteriorate remarkably the quality of the image.

In order to remove the material deposited on the photosensitive member, it is proposed and practically embodied to provide a magnet roller as the cleaning means, by which a layer of magnetic particles is formed on the roller and rubs the surface of the photosensitive member to remove the deposited materials.

Such a magnet roller is also effective to collect the magnetic toner particles to prevent the scattering thereof by disposing it below the cleaning blade, for example, in addition to removal of the above-described deposited material.

Further, when a whitish original having large background which requires only a small amount of toner during image formation, is continuously copied, the friction between the image bearing member and the cleaning member increases with the result of burred blade edge or disturbance to the image by the rosin and talc.

In order to solve the problem, Japanese Patent Application Nos. 216403/1984 and 240842/1984 under the name of the assignee of this application, the toner is deposited on purpose in the non-image area of the image bearing member and is removed by the cleaning station to prevent the burring of the blade by the lubrication by the toner and also to remove the deposited material together with the toner.

Recently, non-black toner has been used to provide two color images or multi-color images wherein, for example, a format and calculation results or data are printed in different colors or wherein a part of a figure outputted from CAD is printed in a different color, for the purpose of making clear and more understandable the information contained in the print. Usually, the non-black toner is at present made of non-magnetic material. When only the non-magnetic toner is used many times, the surface of the magnetic particle layer formed on the magnet roller described hereinbefore as the cleaning means is covered with the non-magnetic toner, with the result that the non-magnetic toner falls outside the container of the cleaning means, thus contaminating the image or the apparatus.

Generally, the non-magnetic toner tends to coagulate more as compared with the magnetic toner, and therefore, insufficient cleaning occurs when the cleaning blade is used.

SUMMARY OF THE INVENTION

Accordingly, it is a principal object of the present invention to provide an image forming apparatus wherein the operation of the cleaning means is kept good, and the scattering of the non-magnetic toner is prevented when non-magnetic toner is used for the image formation.

It is another object of the present invention to provide an image forming apparatus wherein the cleaning of the image bearing member is improved to prevent influence of materials deposited on the image bearing member, to provide good quality of the image.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 11 is a block diagram of a microcomputer system used in the apparatus of FIG. 10.

FIGS. 12*a* and 12*b* show an example of a two-color print wherein an image density thereof is shown in a graph.

DETAILED DESCRIPTION OF THE PREFERRED EMBODIMENTS

Figure 1:
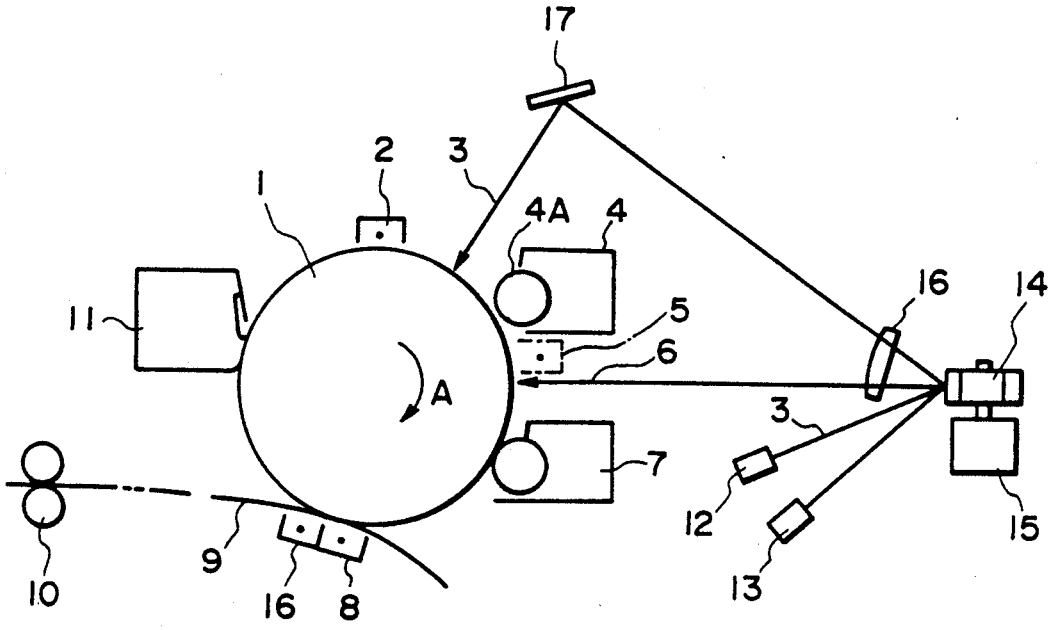
FIG. 1 is a somewhat schematic cross sectional view of a two color electrophotographic apparatus as an exemplary image forming apparatus according to an embodiment of the present invention.
Figure 2A:
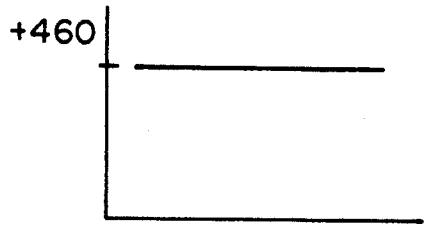
FIGS. 2*a*–2*e* show surface potential of the photosensitive member at each step of the image forming process in the apparatus of FIG. 1 to illustrate image formation thereof.
Figure 2D:
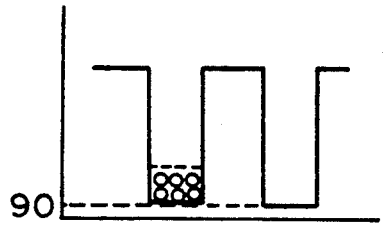
Figure 2B:
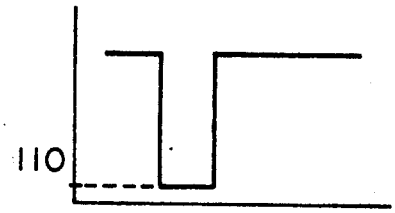
Figure 2E:
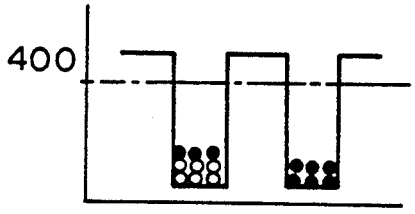
Figure 2C:
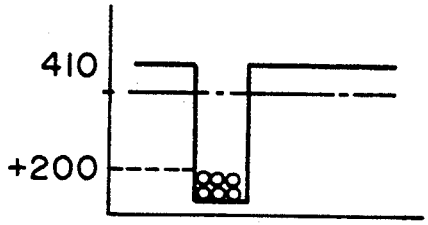
Figure 3A:
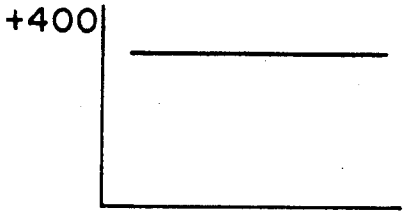
FIGS. 3*a*–3*f* show a surface potential of a photosensitive member each step of an image forming process according to another embodiment to illustrate image formation in the apparatus of FIG. 1.
Figure 3B:
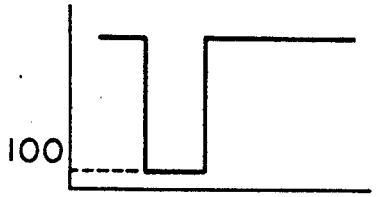
Figure 3C:
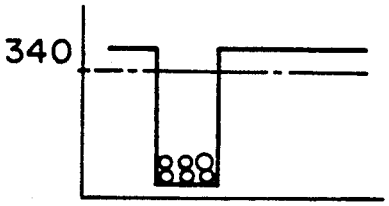
Figure 3D:
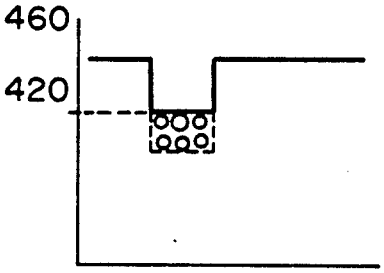
Figure 3E:
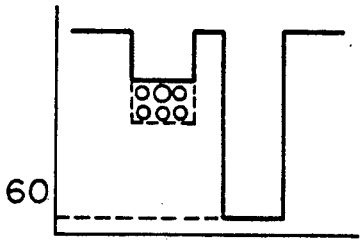
Figure 3F:
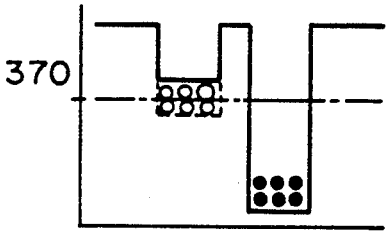

Referring to FIG. 1, there is shown a two-color electrophotographic apparatus as an exemplary image forming apparatus according to an embodiment of the present invention. It comprises an image bearing &0 member 1 in the form of a drum or cylinder, having a photoconductive layer made of amorphous silicon or the like which is rotatable in a direction indicated by an arrow A, which is an electrophotographic photosensitive drum 1. The photosensitive member 1 may comprise an OPC (organic photoconductor) photoconductive layer or a selenium photoconductive layer. Around the photosensitive drum 1, there are disposed various image forming means such as a first charger 2, first image exposure means 3, a first developing device 4, second image exposure means 6, a second developing device 7, a transfer charger 8 and cleaning means 11. If necessary, pre-exposure means (not shown) may be provided between the cleaning means 11 and the first charger 2.

The first image exposure means 3 and the second image exposure means 6 each comprise a first semiconductor laser 12 for emitting a first laser beam modulated in accordance with a first image signal, a second semiconductor laser 13 for emitting a second laser beam and a rotational polygonal mirror 14 driven by a motor 15 to deflect the first and second laser beams so that the beams raster-scan the photosensitive member 1 through an imaging lens 16 and a folding mirror 17 imagewisely to form a first image and a second image. As will be described hereinafter, a recharger (second charger) 5 may be provided between the first developing device 4 and the second image exposure means 6.

Referring to FIGS. 2 and 3, the description will be made as to an operation of the two-color electrostatic photographic apparatus. The photosensitive drum 1 is rotated in the direction A and is uniformly charged by the first charger 2 to +460 V, for example (FIG. 2(*a*)). The first exposure means 3 forms on the photosensitive member 1 a first latent image having a potential of +110 V, for example, at the light area (FIG. 2(*b*)). The first latent image is reverse-developed by the first developing device 4 with red toner, for example, with an appropriate bias voltage applied (FIG. 2(*c*)). The red toner is a non-magnetic toner and is electrically charged by friction with carrier particles made of magnetic particles. The red toner is carried on a developing sleeve 4*a* containing therein a magnet and brushes the photosensitive member 1 to develop the latent image. By the development, the potential of the red toner image is increased by approximately 100 V by the charge of the toner to become approximately 200 V.

Next, a second image signal is applied to the photosensitive member 1 by the second exposure means 6, by which a second latent image having a surface potential, for example, +90 V at the exposed area is formed on the photosensitive member 1 (FIG. 2(*d*)). As another method, it is possible that the second charges 5 is used to re-charge the photosensitive member 1 after the first latent image is visualized, by which the potential of the first toner image is increased up to +420 V, as shown in FIG. 3(*d*), and then, the second image exposure means 6 is operated to decrease the exposed area potential down to +60 V (FIG. 3(*e*)).

The second latent image formed in this manner, is visualized by the second developing device 7 with black toner, for example, with an appropriate bias voltage being applied (FIG. 2(*e*), FIG. 3(*f*)). The black toner is a one component magnetic toner, in this embodiment, subsequently, the two-color image thus formed on the photosensitive member 1 is transferred onto a transfer material 9 by a transfer charger 8, and then the transfer material 9 is separated from the photosensitive drum 1 by a separation charger 16. Then, the transfer material 9 is transported to an image fixing means 10, where the two-color image is fixed and is discharged outside as a print.

Next the photosensitive drum 1 is cleaned by the cleaning device 11 by which the toner remaining thereon is removed, and is used for the next image forming process.

Figure 4:
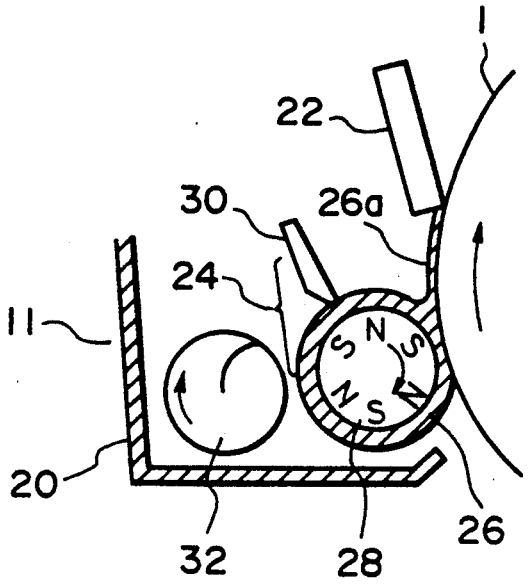
FIGS. 4 and 5 are sectional views of cleaning devices of the image forming apparatus according to the present invention.

FIG. 4 shows an example of the cleaning device 11, wherein the cleaning device 11 comprises a container 20 in which a cleaning blade 22 made of elastic material such as urethane rubber or the like and magnet cleaning means 24 are provided. The magnet cleaning means 24 includes a magnet roller 28 having an outer peripheral surface on which a layer of magnetic particles (a layer 26 of the magnetic toner particles in this embodiment) is formed, and a layer thickness regulating member 30 for regulating the thickness of the magnetic toner layer 26 on the magnet roller 28 to a predetermined level.

With the structure, the materials such as the remaining toner or the like on the photosensitive drum 1 are brushed by the magnetic toner particle layer 26 on the magnet roller, and therefore, are removed or eased in its deposition force. Further, by the contact of the photosensitive drum 1 with the magnetic toner layer 26, the photosensitive drum 1 is coated with a magnetic toner particle layer 26*a*. The toner layer 26*a* is removed from the surface of the photosensitive drum 1 by the cleaning blade 22 together with the remaining toner particles and the other deposited materials.

The removed residual toner and materials are discharged to an unshown collecting container by a conveying screw 32.

When the non-magnetic toner is collected as the residual toner by the cleaning device 11 having the structure described above, the non-magnetic toner is physically or electrically deposited on the magnetic toner layer 26 on the magnet roller 28, and therefore, are retained on the magnet roller 28 together with the magnetic toner.

However, when a larger amount of the non-magnetic toner is used than the magnetic toner in the image formation, for example, when a large number of red copies are produced, the magnetic toner layer 26 on the magnetic roller 28 on the cleaning device 11 is covered with the non-magnetic toner collected back, and therefore, there arises a liability that the non-magnetic toner particles are scattered, or they fall, thus contaminating the inside of the apparatus.

According to this embodiment, in order to solve this problem, when the non-magnetic toner is used during the image formation, the magnet roller 28 of the cleaning device 11 is forcedly supplied with the magnetic toner.

More particularly, when the non-magnetic toner, that is, the red toner in this embodiment, is used for the image formation, the magnetic toner, that is, the black toner, is supplied to the magnet roller 28 of the cleaning device 11 depending on the conditions under which the non-magnetic toner is used. Further particularly, when the red toner is used, the black toner (magnetic toner) is supplied to the magnet roller 28, depending on the condition, to the non-image area of the photosensitive member, which is the area where no latent image is formed, that is, the area of the photosensitive member which corresponds to the space between adjacent transfer materials, and therefore, which is not contacted to the transfer materials continuously supplied, and also to the area of the photosensitive member which is developed during a post-rotation of the photosensitive member and is carried to the cleaning device without being subjected to the image transfer operation.

Figure 6:
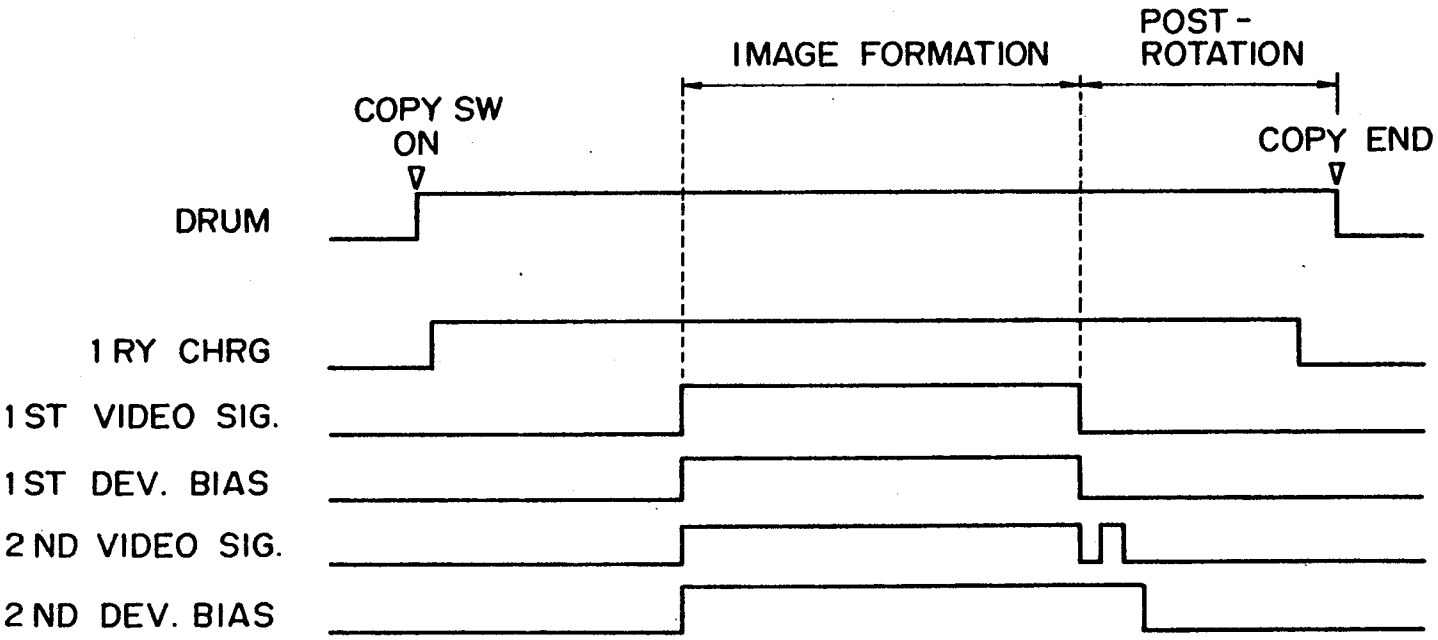
FIGS. 6 and 7 are time charts illustrating operational sequences in an image forming apparatus according to the present invention.

Referring to FIG. 6, the description will be made as to the operational sequence of the two-color image forming apparatus according to this embodiment, particularly with respect to the black toner development operation to the non-image area of the photosensitive member.

FIG. 6 is a time chart illustrating the sequence when one copy is produced. Instantaneously with actuation of the copy switch, the photosensitive member 1 is driven, and the first charger 2 is actuated to charge the photosensitive member 1 to a proper potential. Then, the first video signal (first laser signal) of the first image exposure means 3 is produced, and the first development bias of the first developing device 4 is actuated. The first latent image is formed and is developed with the red (non-magnetic) toner. Also, the second video signal (the second laser signal) of the second image exposure means 6 is produced, and the second developing bias of the second developing device is actuated, so that the second image is developed with the black (magnetic) toner.

Upon completion of the image formation, the first video signal of the first image exposure means 3 and the first developing bias of the first developing device 4 are deactuated, and the second video signal of the second image exposure means 6 is deactuated. Then, the post rotation starts, by which the second video signal is produced from the second image exposure means 6 to form a latent image in the form of a line or lines (stripes). The line latent image is developed with the black (magnetic) toner by the second developing device 7.

The line image developed with the magnetic toner is not transferred to the transfer material and is supplied to the magnet roller 28 of the cleaning device 11, by which the magnetic roller 28 is prevented from being covered by the non-magnetic toner.

Figure 7:
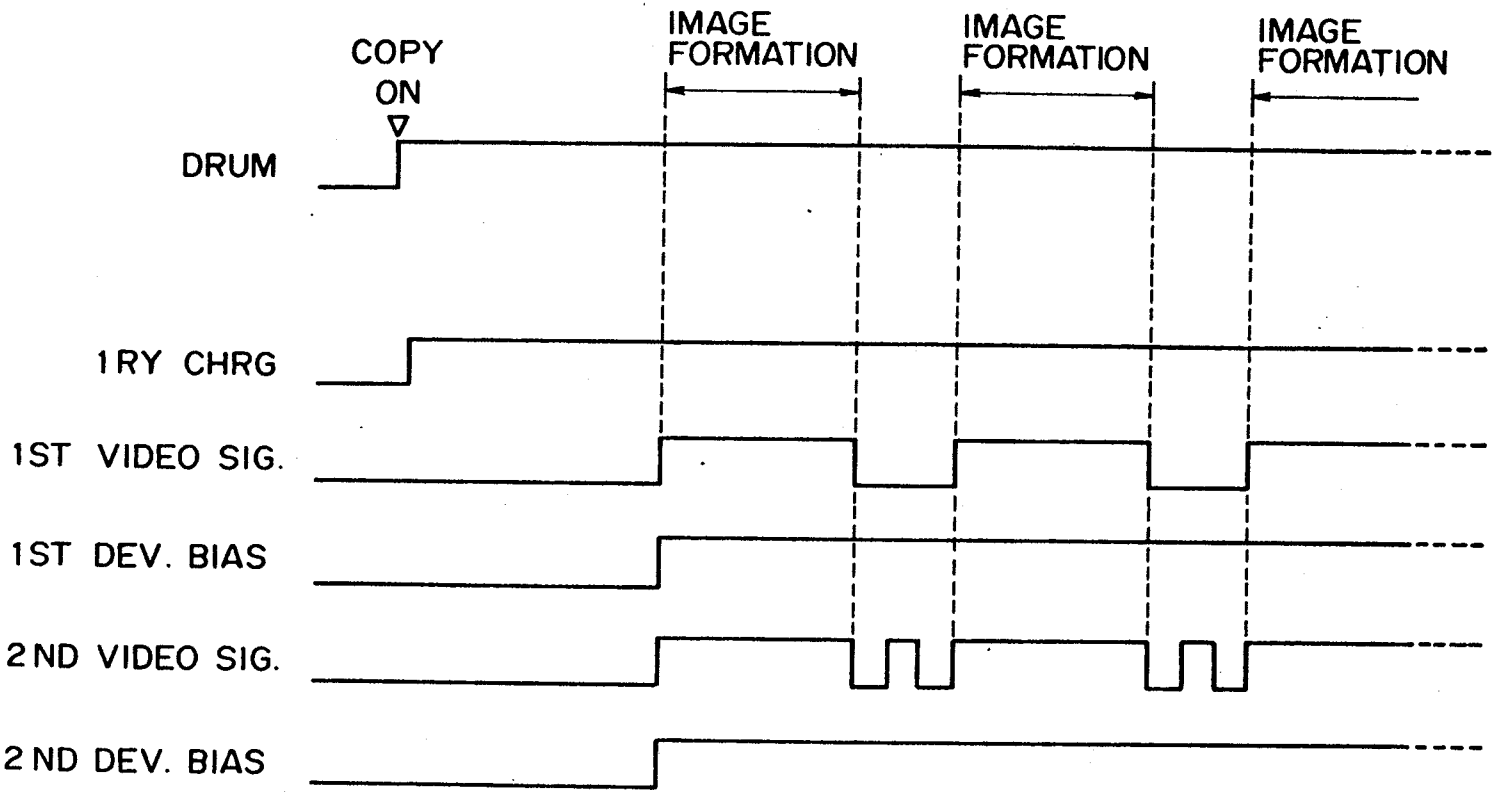

FIG. 7 is a time chart illustrating the sequence in the continuous copy operation, wherein the line latent image is formed in the space between adjacent transfer materials, and the line latent image is developed by the magnetic toner.

In this manner, the magnetic toner is deposited onto the non-image area, that is, between the transfer sheets or during the post-rotation, by which the magnet roller of the cleaning device is supplied with the black toner, and therefore, the solution is provided to the problem that the magnet roller is covered with the non-magnetic toner, that is, the red toner in this embodiment, resulting in the scattering and falling of the red toner which contaminates the inside of the apparatus.

In this embodiment, the width of the line formed between a transfer sheet or during the post rotation is approximately 2 mm, and the length thereof is equal to that of the developing speed. The toner consumption per one line is 0.01 g, which is equivalent to the residual red (non-magnetic) toner after the image transfer.

Figure 8:
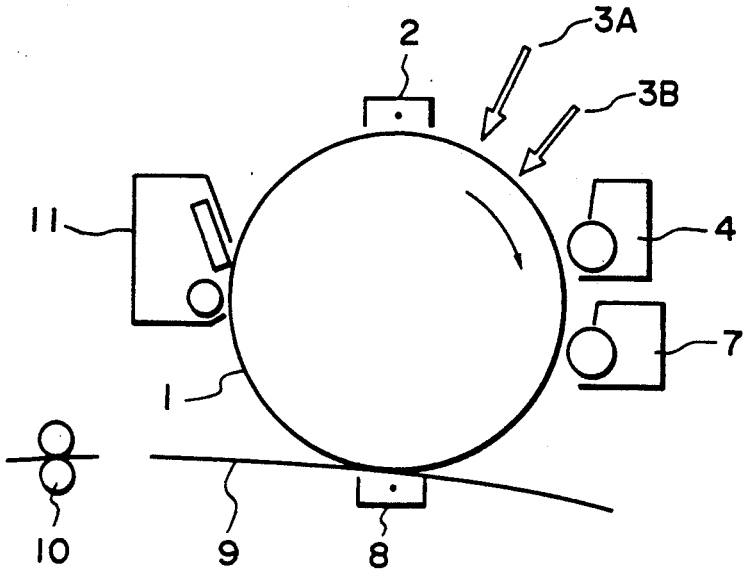
FIG. 8 is a somewhat schematic cross sectional view of a two color electrophotographic apparatus according to another embodiment of the present invention.

FIG. 8 shows an analog type two-color electrophotographic copying apparatus according to another embodiment of the present invention, in which image exposure means 3A and blank exposure means 3B are disposed between the first charger 2 and the first developing device 4. The blank exposure means 3B exposes the non-image area of the photosensitive member which has been charged to attenuate the electric charge in the area. The photosensitive member is uniformly charged by the first charger 2, and is exposed to image light by the image exposure means 3A, by which a latent image for red color is formed. It is visualized with red (non-magnetic) toner by the first developing device 4, and thereafter, the photosensitive member is subjected to the image transfer operation and the cleaning operation. Subsequently, the photosensitive member is re-charged by the first charger 2, and is exposed to image light by the image exposure means 3A, by which a latent image for black color is formed. The latent image is visualized with the black (magnetic) toner by the second developing device 7. Through the image transfer step, a two-color copy is produced. In this embodiment, the developing operation is a regular development wherein the toner is deposited to the area of the photosensitive member which has not been exposed to light, and therefore, which has a high potential.

Figure 9:
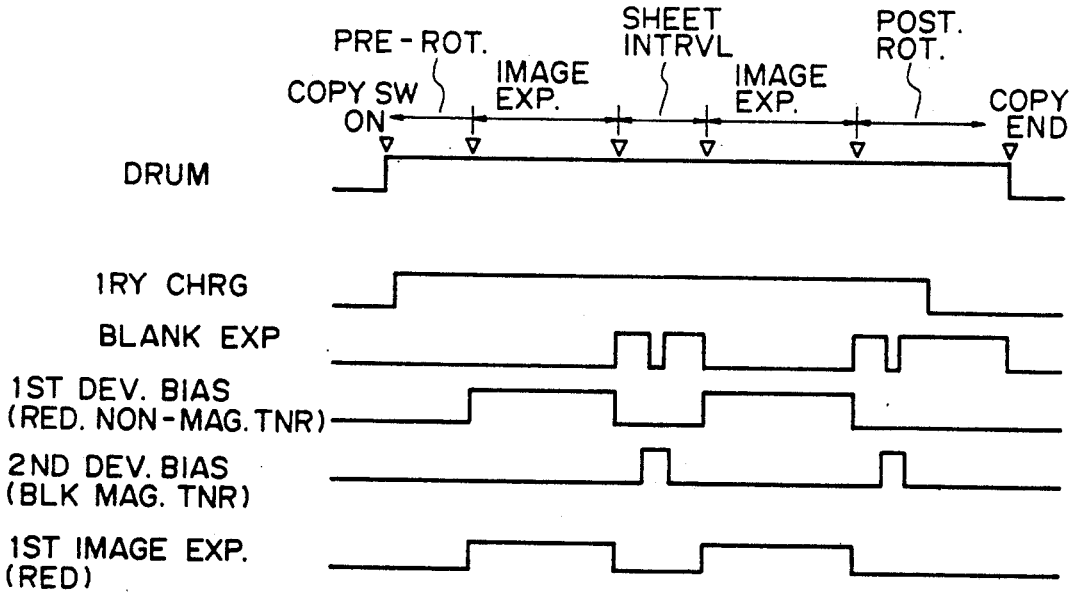
FIG. 9 is a time chart illustrating operational sequences of the apparatus shown in FIG. 8.

Referring to FIG. 9, there is shown a development sequence with the black (magnetic) toner to the non-image area when two red image copies are continuously produced. The blank exposure means 3B is rendered "off" for a short period of time between the adjacent transfer materials and during the post-rotation, and the developing bias of the second developing device 7 for the black toner is actuated, so that the black toner is deposited onto the photosensitive member 1. Instead, the black toner may be deposited by actuating and deactuating the developing bias without use of the blank exposure means 3B. Upon continuous copying operation, the supply of the magnetic particles may be effected for every plural interval between the transfer sheets instead of each of the intervals.

The description will be made as to some examples of a control system for supplying the magnetic particles to the cleaning means in accordance with the information relating to the state of usage of the non-magnetic toner when the non-magnetic toner is used for the image formation.

EXAMPLE 1

Figure 10:
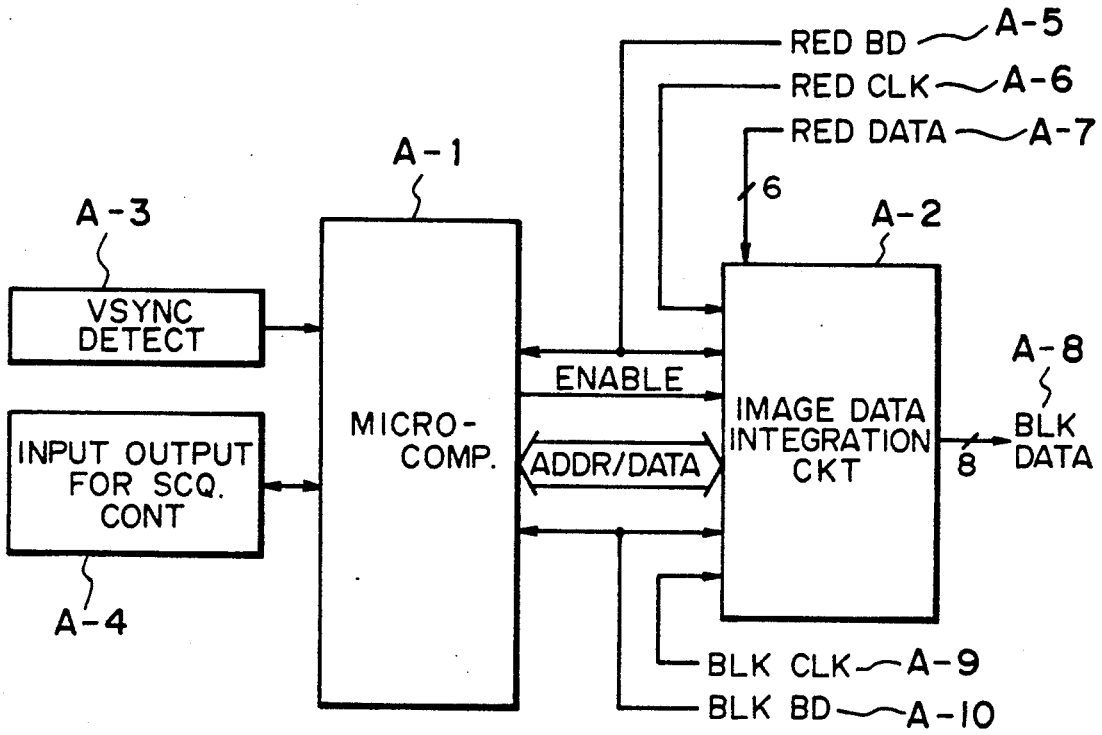
FIG. 10 is a block diagram of an image forming apparatus according to the present invention.

FIG. 10 illustrates this example, wherein the control system comprises a microcomputer system A-1, an image data integrating circuit A-2, a circuit A-3 for transmitting to the microcomputer system A-2, a signal indicative of a leading edge of a print sheet on which the image is recorded to instruct timing of a signal representative of the head of one page print and an output driver A-4 for the sequential control for controlling the electrophotographic apparatus.

As shown in FIG. 11, the microcomputer system A-1 includes a 16 bit CPU (central processing unit) B-1, peripheral devices B-2–B-7 connected with the CPU by address/data bus, more particularly, a ROM (read only memory) B-2 storing the program controlling the operations of the electrostatic copying apparatus, a RAM (random access memory) B-3, a time generator B-4, a serial controller B-5 for communicating with another CPU not shown, a controller B-6 for controlling plural interruption signals and input and output port B-7.

The microcomputer system A-1 and the image data integrating circuit A-2 receive a horizontal synchronization signal (BD) A-5 of the red signal laser beam and a horizontal synchronization signal (BD) A/10 for the black signal laser beam, and the image data integrating circuit A-2 receives red and black clock signals A-6 and A-9, and a red data signal A-7.

Together with the horizontal synchronization signal (BD) A-5 for the read signal laser beam, the image signals for the longitudinal length of one page, 297 mm in the case of A4 size. In this example, the resolution of the image is 16 dots/mm on the photosensitive drum. Therefore, 1/16 data is inputted into the detection circuit of the integration circuit A-2. The clock A-6 is 1/16 of the laser writing, and therefore 297 clocks are introduced for one line. In other words, the data for one picture element are taken per 1 mm. Both of the main and subordinate scanning operations are effected with this 1/16 bases. Therefore, in the case of A4 size paper 257×210 picture elements are used.

The data A-7 inputted into the image integration circuit A-2 and to be produced from the read signal laser are 8 bit data per one picture element in this embodiment, and when the laser is produced, the image is formed by dividing into 256 segments the on-period for one picture element. Only the upper 6 bits of the data introduced into the integration circuit A-2 are inputted per one picture element.

The data A-8 are not image data, but 8 bit data for black signal laser used for the black toner development sequence for the non-image area between the transfer sheets (sheet for the print). On the basis of this data, the laser on-period for the one picture element on the photosensitive drum is controlled, so that a larger amount of black toner is deposited for the portions where a large amount of red toner is consumed. At this time, the main scanning is effected with the solution of 1 dot/mm, and therefore, the clock A-9 is produced 297 times at the same speed as the clock A-6. However, the subordinate scanning runs at 16 dot/mm which is the standard resolution. Therefore, the horizontal scanning signal (BD) A-10 of the black signal laser beam is 16 times the horizontal synchronization signal (BD) A-5 for the read signal laser beam.

Figure 13:
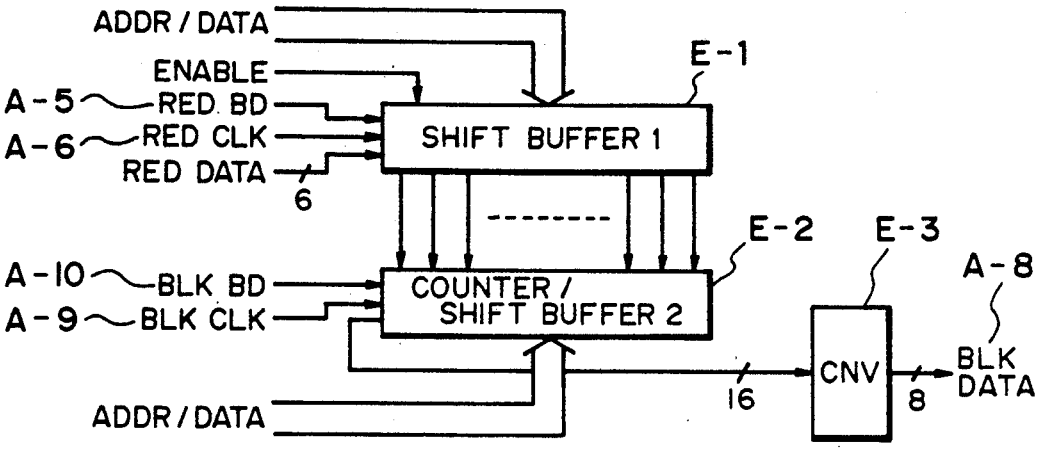
FIG. 13 is a block diagram of an image data integrating circuit used in the FIG. 10 apparatus.

Referring to FIGS. 12 and 13, the operational principle of the above structure will be described. In FIG. 12(*a*), there is shown a print sheet C-1 corresponding to the transfer material 9 of FIG. 1. On the print sheet C-1, a red image C-2 shown in FIG. 12(*a*) is formed, which is an image produced by visualizing by the red developing device a latent image formed on the photosensitive drum by the red signal laser.

According to this embodiment, as described hereinbefore, for the portion having a large amount of red portion (a, c portions in FIG. 12(*a*) as seen in the main scanning direction (the subordinate scanning direction is the direction of the arrow in FIG. 12(*a*)), the black toner (magnetic toner) development is effected with the black developing device in the non-image area of the photosensitive member after one page image forming is completed, by which the black toner is supplied to the cleaning device 11.

FIG. 12(*b*) shows the result of the integration of the red image of FIG. 12(*a*). The integration is performed by the image data integrating circuit A-2.

FIG. 13 shows an example of a block diagram illustrating an operation of the image data integrating circuit A-2.

In the image data integrating circuit A-2, a first shift buffer E-1 of 6 bit×297 shifts by one datum (6 bits) on the basis of the clock A-6. A count buffer E-2 adds in parallel the data introduced from the shift buffer E-1 on the basis of the red BD signal A-5.

In the count buffer E-2 one datum is constituted by 16 bits, and each datum is converted by (content of E-2)+(content of E-1)=(content of E-2) when it is transmitted from the shift buffer E-1 to the count buffer E-2.

After completion of the integration for one print sheet, the count buffer E-2 functions as a second shift buffer to produce with shift 16 bit integrated data on the basis of the clock A-2 with the reference of the horizontal synchronization signal (BD) A-10 for the black signal laser. However, the laser output is controlled on the basis of 8 bits, and therefore, the 16 bit integrated data are introduced into a circuit E-3 for the conversion to 8 bit data.

The method of conversion is such that if the input 16 bit signal $D_{16}$ to the circuit E-3 is larger than 1000 H, the 8 bit output signal $D_8$ is made 80 H. In the range of $0FFFH \geqq D_{16} \geqq 0000H$, $D_{16}$ is shifted rightwardly by 5 bits. For example, $D_{16}$=123 H, $D_8$32 9 H.

Thereafter, $D_8$ is converted to $D_8$+10 H unconditionally. In order to deposit a small amount of the black toner on the photosensitive member even when $D_8=0$.

Figure 15:
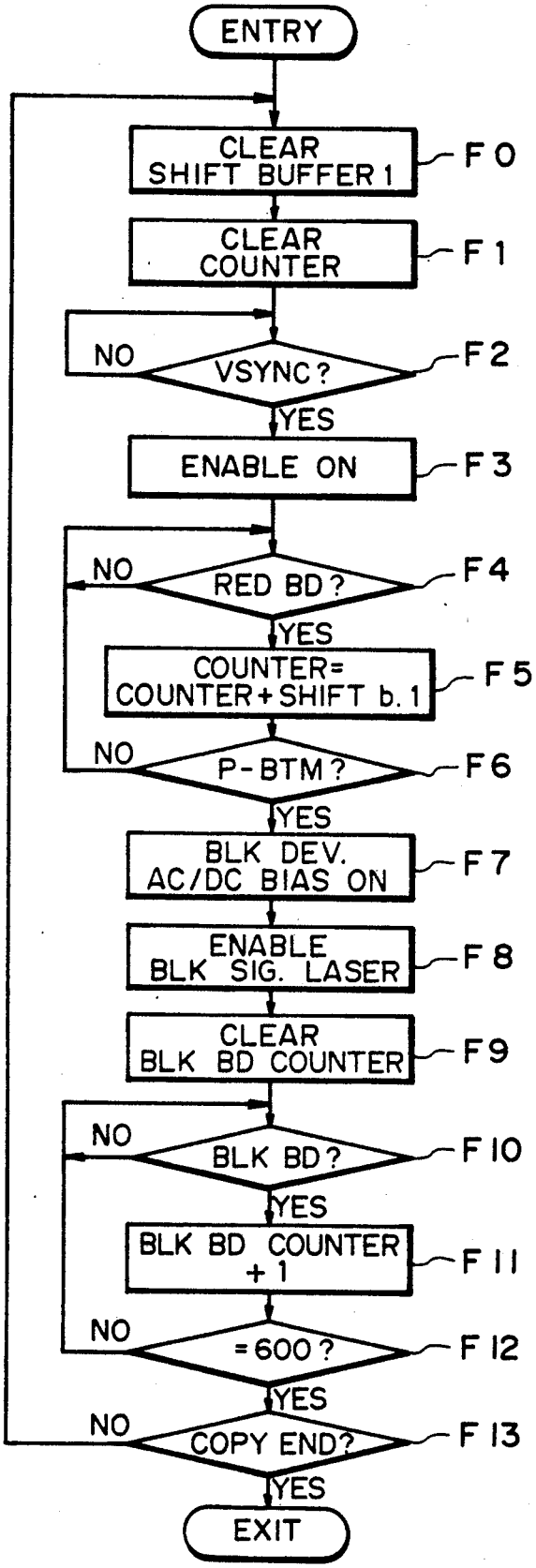
FIG. 15 is a flow chart illustrating operational sequence in an apparatus according to the present invention.

The operation of this example will be described in more detail in conjunction with the flow chart shown in FIG. 15. Prior to the start of the red signal integration, the shift buffer E-1 and the count buffer E-2 are reset so as to clear the contents thereof (steps F0 and F1).

A signal Vsync indicative of a leading edge of an image for one print page is waited for (step F2), and when it becomes "yes", an enabling signal (ENABLE) enabling the operation of the integration circuit A-2 is actuated (step F3). The red BD signal indicative of one line of the laser beam is waited for, and during the waiting period, the data is stored in the shift buffer E-1 (step F4). Upon "yes" signal at step F4, that is, upon detection of the red BD signal, the data is added and transferred from the buffer E-1 to the integration buffer E-2

(step F5). The steps F4–F6 are repeated until one full page of the print sheet is covered.

Upon completion of the integration for one full page of the print sheet 1 (step F6), the AC/DC bias of the black developing device is controlled to develop the photosensitive drum with the black toner (step F7). The laser for the black color is enabled (step F8), and the black BD counter for outputting 600 line data is reset (step F9). Then, the input of the black BD signal is waited for, and during the waiting period, the data for applying the black toner is outputted (step F10).

The count of the black BD counter is added by +1 (step F11), and the discrimination is made as to whether 600 line data are outputted or not (step F12). If smaller, the sequence goes back to the step F10, by which the data for the application is outputted. Upon production of "yes" signal at step F12, the discrimination is made as to whether or not the copy operations for the set number of copies are completed, and if a further print is necessary, the sequence goes back to the step F0 (step F13).

Figure 14:
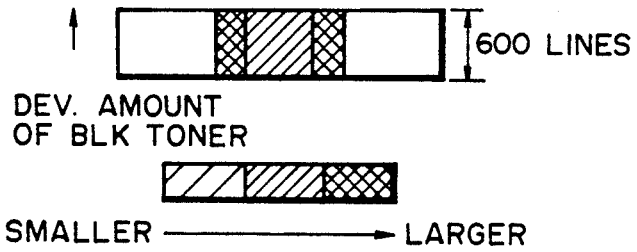
FIG. 14 illustrates development with non-magnetic toner used in the present invention.

FIG. 14 schematically shows amounts of black toner in the black developing device, in the above described operation of the image formation. In this Figure, the arrow indicates the subordinate scanning direction, and the position and the amount of the black toner corresponding to the position where the red toner is used and to the amount of the red toner consumed, respectively, are shown.

In this embodiment, it is preferable that for the region where the red toner is not used, a slight amount of black toner is applied. This is because the red toner is deposited at a position of the magnet roller which corresponds to the portion where the large amount of red toner is not used, because of the scattering or the like of the red toner in the cleaning device.

In this manner, the magnetic toner can be applied to the non-image region of the photosensitive member between the adjacent transfer sheet or during the post-rotation, so that the magnet roller of the cleaning device can be supplied with the black toner. Therefore, the solution is provided to the problem that the magnet roller is covered with the non-magnetic toner (red toner in this embodiment) with the result of the scattering or the falling of the red toner to contaminate the inside of the apparatus.

Experiments of image formation incorporating the above-described embodiment were carried out with the structure shown in FIG. 1 using an amorphous silicon photosensitive member having a diameter of 108 mm and with the image forming process speed of 343 mm/sec. When a test chart having an image portion content of 10% was copied only with red toner, intermittently and continuously. After 50,000 sheets of A4 size were intermittently copied, and after 100,000 sheets were copied continuously, no red toner was scattered outside the container of the cleaning device, and the contamination of the image and the inside of the apparatus were not at all observed.

In these experiments, the diameter of the magnet roller of the cleaning device was 18 mm; the surface magnetic flux density was 1000 Gauss; the magnet roller had 6 poles; the peripheral speed thereof was 250 mm/sec; the clearance between the photosensitive drum and the magnet roller was 1.0 mm; the clearance between the magnet roller and the toner layer thickness regulating member was 1.3 mm.

EXAMPLE 2

In the Example 1, the position where the red toner is consumed and the amount of the red toner (the integrated period in which the red laser is actuated) are detected, and a corresponding amount of the black toner is applied at a corresponding position.

However, in order to reduce the number of required memory devices used in the apparatus, it is possible that the position where the red toner is consumed is not detected, and the amount of the red toner consumption only is detected, and the black toner is applied uniformly along the longitudinal direction of the photosensitive drum.

Figure 16:
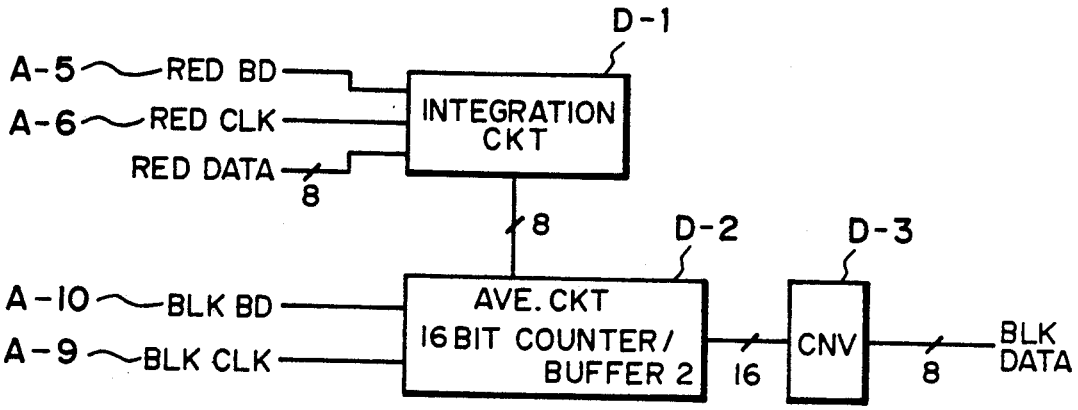
FIG. 16 is a detailed block diagram of another example of an image data integrating circuit used in the apparatus of FIG. 10.

FIG. 16 shows a block diagram of the image data integrating circuit A-2 showing an example thereof. In this example, the buffer D-1 is a shift buffer of 6 bits×297 and includes an integrating circuit having an increment of 1 line on the bases of the clock A-6. The count buffer D-2 adds the data from the integrating circuit D-1 on the basis of the red BD signal A-5. At this time, one datum produced by the count buffer D-2 is constituted by 16 bits. Therefore, each datum when it is transferred from the integrating circuit D-1 to the counter buffer D-2 is converted by (content of D-2)+(content of D-1)=(content of D-2).

After integration for one print sheet is completed, the count buffer D-2 functions as a shift buffer, so that the integrated data (16 bits) are produced on the basis of the clock A-9 with the reference of the horizontal synchronization signal BD of the black signal laser.

Figure 17:
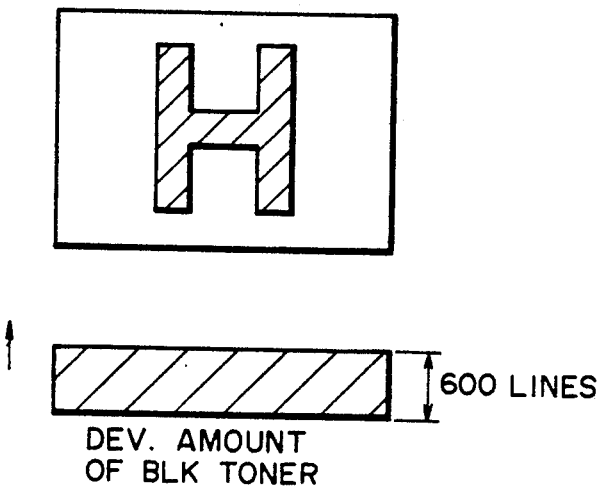
FIG. 17 illustrates development with magnetic toner according to the present invention using the image data integrating circuit of FIG. 16.

FIG. 17 schematically shows the application of the black toner in the space between adjacent sheets or during the post rotation, after the same red image as in FIG. 12(*a*) is formed. The black toner is uniformly applied by the black developing device along the entire width of the sheet in an amount corresponding to the amount of all the red toner consumed for the red image formation.

EXAMPLE 3

In Example 2, the total time period in which the red laser is actuated is integrated, and the black toner is applied to the non-image area on the average thereof.

Between the method of Example 1 and the method of Example 2, there is an in-between method wherein, for example, the photosensitive member is divided into four sections along the length of the photosensitive member, and the red laser on-period is integrated for each of the sections, and an average amount of the black toner is applied to the non-image area.

Figure 18:
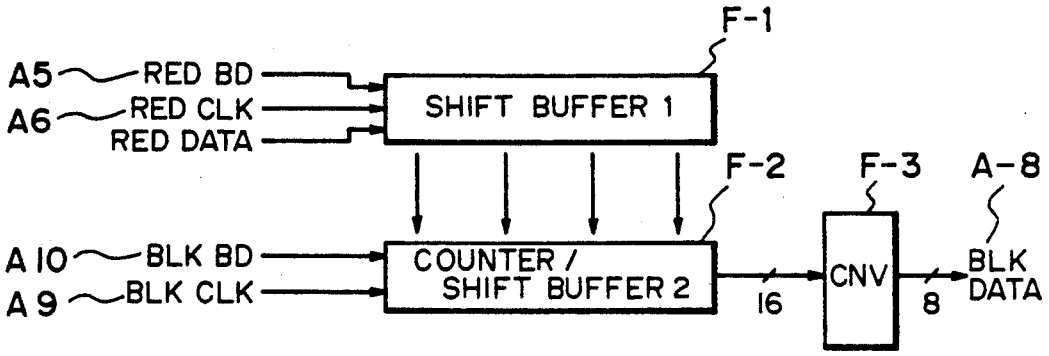
FIG. 18 is a detailed block diagram of an image data integrating according to a further embodiment.

FIG. 18 shows such an intermediate example.

In this embodiment, the buffer F-1 is a shift buffer of 6 bit×297, and having an integrating circuit having an increment of ¼ line on the basis of the clock A-6. The count buffer F-2 adds the data from the integrating circuit F-1 on the basis of the red BD signal A-5. At this time, one datum produced from the count buffer F-2 is constituted by 16 bits.

The operation of this example is similar to that of Example 1 or 2.

Figure 19:
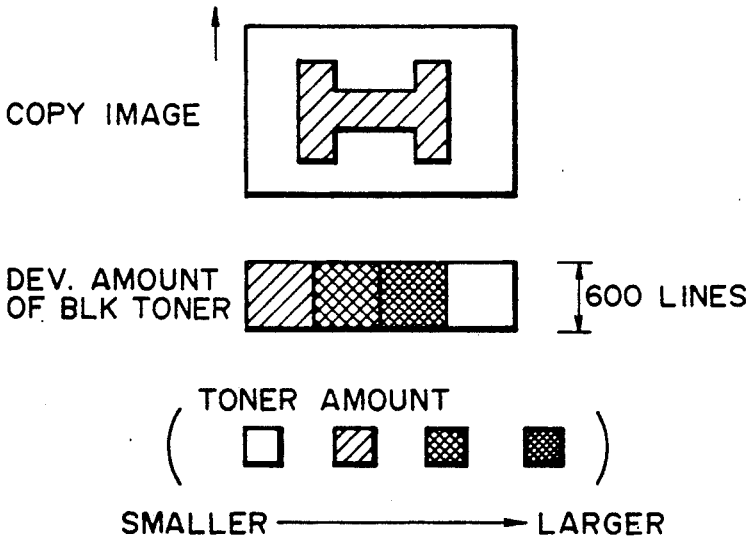
FIG. 19 shows development with magnetic toner using the image data integrating circuit of FIG. 18.

FIG. 19 schematically shows an amount of the black toner applied to the non-image area, corresponding to the red image. The arrow indicates the subordinate scanning direction.

According to this example, the image is divided into four sections in the main scanning direction, and the black toner is applied to the non-image area, corresponding to the integrated period of the red laser actuation.

EXAMPLE 4

In this example, the integrated on-period of the red laser is not detected, but the exposure position by the red laser is only detected, and a predetermined amount of the black toner is applied to the position corresponding to the exposure position irrespective of the amount of development with the red toner.

EXAMPLE 5

Figure 20:
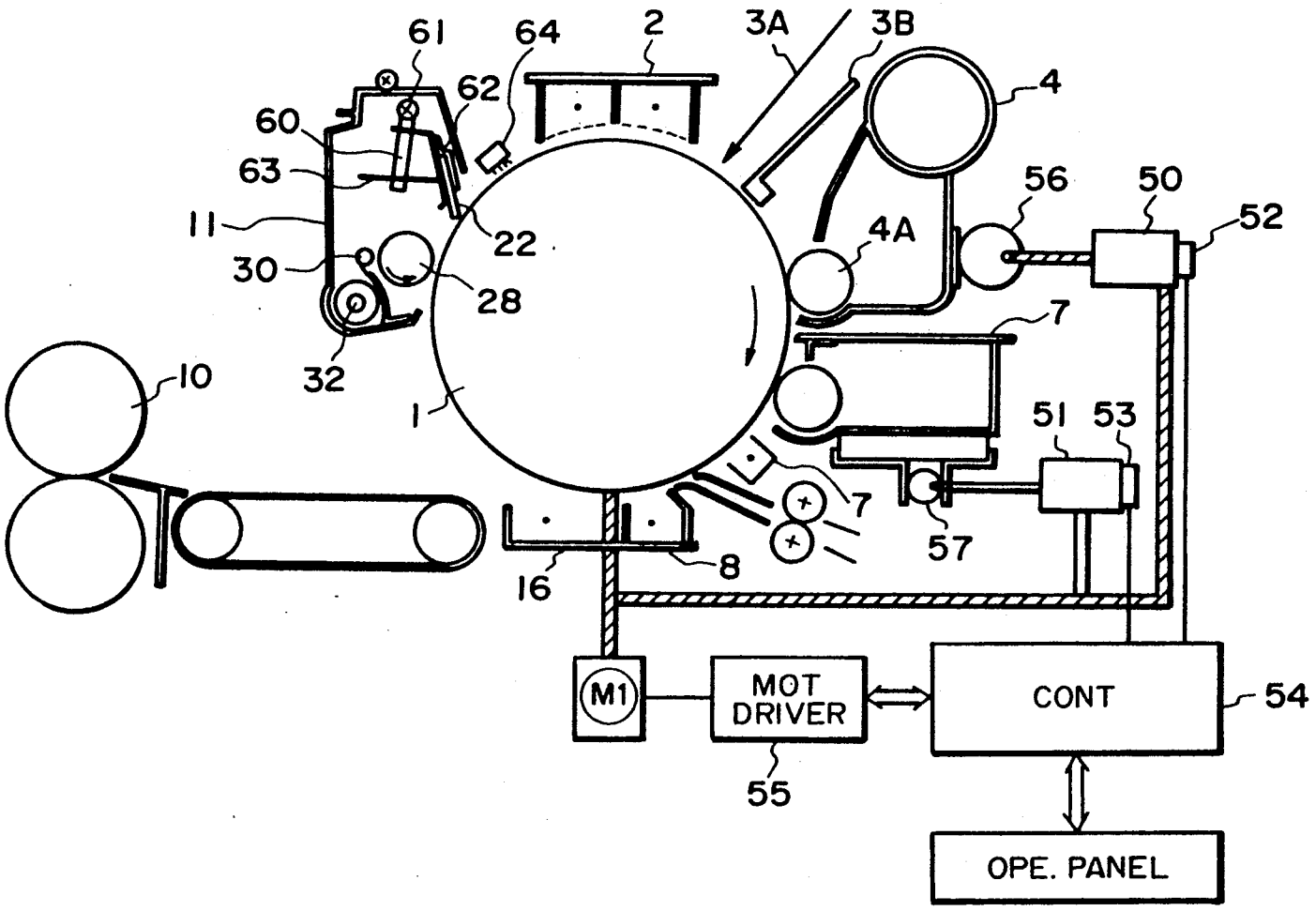
FIG. 20 is a somewhat schematic sectional view of a two-color image forming apparatus as an exemplary image forming apparatus according to a further embodiment of the present invention.

Referring to FIG. 20, there is illustrated a further embodiment, wherein the same reference numerals are assigned to the corresponding elements, and the detailed description is omitted for simplicity. In FIG. 20, the apparatus includes exposure means 3 which projects an image of the original on the photosensitive member 1 by an unshown optical system. It also comprises an LED lamp 3B for blank exposure.

When the operator depresses an unshown color selection button, the controller 54 transmits the on-off signal from the controller 54 to the solenoids 52 and 53 for controlling the clutch 50 for pressing the first (red) developing device to the drum and the clutch 51 for pressing the second (black) developing device to the drum.

On the other hand, the controller controls the motor M1 through a motor driver 55. The motor M1 is operatively connected with clutches 50 and 51 through unshown driving gears. By the engagement and disengagement of the clutches, the rotation of the eccentric cams 56 and 57 are controlled, by which the first and second developing devices are contacted to and disengaged from the photosensitive drum 1. By selectively engaging the first developing device or the second developing device, a multi-color (two color) development is possible.

The cleaning device 11 includes a blade 22 of an equalizing type, and the blade contact pressure is made uniform along the length of the photosensitive drum 1 by rotational shaft 60. Another rotational shaft 61 extends parallel with the rotational axis of the photosensitive drum 1 perpendicular to the rotational axis 60. By rotation of the shaft 61, the blade 22 is selectively contacted o disengaged from the photosensitive drum 1.

The rubber blade 22 is interposed and fixed between the blade confining plate 62 and the blade mounting plate 63. A doctor roller 30 is made of non-magnetic metal and rotates at a slow speed in the direction indicated by an arrow and is effective to regulate the thickness of the magnetic particle layer on the magnet roller 28 to 1.3 mm. The magnet roller 28 is spaced from the photosensitive drum 1 by a gap of 1 mm, and the magnetic particle layer on the roller 28 brushes the photosensitive drum 1. Designated by a reference numeral 64 is a discharge lamp for discharging the photosensitive member 1.

As described, by the rotation of the eccentric cams, the contacts of the developing devices to the photosensitive member are controlled. Where a red copy is produced after black copy is produced, the pressure of the black developing device to the photosensitive member is released, and then the red developing device is pressed to the photosensitive member and is placed in an operative condition, and subsequently, the image formation with the red toner is performed. In this embodiment, the start and stop signals are transmitted to the pressure-on period integrating counter. The pressure-on period is integrated in response to the signals from the timer. When the integrated period reaches a predetermined, a black stripe or stripes are deposited onto the photosensitive member with the magnetic toner. The black stripe is the same as has been described with the foregoing embodiment.

Figure 21:
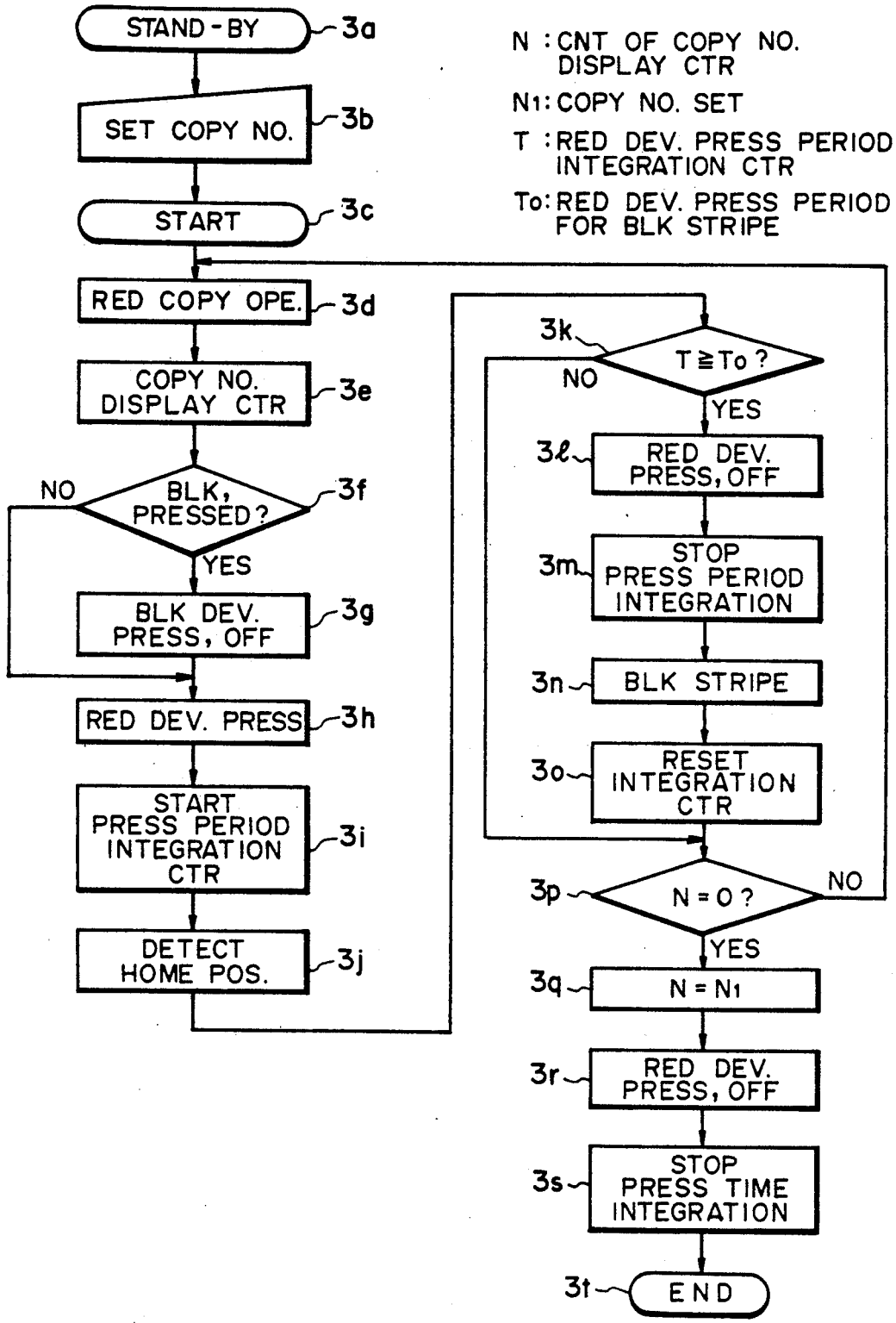
FIGS. 21, 22, 23 and 26 show flow charts illustrating an operational sequence according to another embodiment of the present invention.

FIG. 21 is a flow chart for applying the magnetic toner to the cleaning device.

In the stand-by state **3*a*, the user carries out a setting operation 3*b* such as copy number setting. Then, the copy start key 3*c* is depressed, by which the red copy operation 3*d* starts, if so selected. In response to the copy start signal, various control operations are performed, as shown in FIG. 9, for the rotation of the photosensitive member, the operation of the charger and the others. However, the flow chart of FIG. 21 omits those, and only the controls of the developing device pressing action and the black stripe formation are shown for the simplicity. When the red copy operation starts, the count N of the copy number displaying counter is reduced by one, that is, to N−1. Then, the discrimination is made as to whether or not the black developing device is pressed to or disengaged from the photosensitive member (3*f*). If the black developing device is pressed, the black developing device is disengaged (3*d*). Then, the red developing device is pressed thereto. To accomplish this pressed state, a signal is transmitted to the solenoid 52 shown in FIG. 20**, and simultaneously, the integrating counter for the pressure-on period of the red developing device in the controller is started, and the period is integrated in response to the signals from the timer contained in the controller.

The discrimination as to whether or not the count T of the integrating counter is not less than the red developing device on-period T0 requiring the black stripe is made at a point of time when the optical system or the original carriage moves reversely to its home position, or at a point of time when it reaches the home position (**3*k*). This is done because upon continuous copying mode, the developing device is maintained pressed to the photosensitive member, and therefore, the pressed state continues after the developing device pressure-on period is discriminated. The threshold time T0 is stored in a RAM in the controller. When the pressure-on period exceeds the threshold T0, the black stripe is formed (3*n*). More particularly, in response to a signal produced from the controller 54 (FIG. 20), the solenoid 52 and the clutch 50 are controlled so that the eccentric cam 56 rotates by which the first developing device is disengaged from the photosensitive drum 1. Next, the eccentric cam 57 rotates in response to the signal from the controller 54 so that the second developing device is contacted to the photosensitive drum 1 during which time the surface potential of the photosensitive drum 1 is controlled so as to be low enough to prevent the toner from being deposited onto the photosensitive drum. This is accomplished by lighting the LED lamp 3B** for the blank exposure. The developing device is kept being supplied with the bias voltage.

The control timing for the production of the black stripe is as shown in FIG. 9.

When the black stripe is produced, the integrating counter is reset (T=0). Then, the discrimination is made as to whether or not the count of the copy number displaying counter is 0 (**3*p***) if so the copying operation ends.

The copy number displaying counter is reset immediately before completion of the copy, so that the initial state (N=n1) is restored, by which all the operations are completed. If N is not zero, the copying operation is continued.

In the manner described above, the copying operation is carried out with the non-magnetic toner, and when the time period in which the developing device containing the non-magnetic toner exceeds a predetermined level T0, the magnetic toner is supplied to the cleaning device as a developed black stripe.

In this embodiment, the use is made with the time information which is the developing device on-pressure period, the amount of toner collected by the cleaning device and the red/black ratio on the magnet roller surface of the cleaning device can be predicted on the basis of other time information. Any information is usable for this purpose, provided that it has a certain degree of correlation with the red/black ratio or to the amount of the non-magnetic toner collected by the cleaner, although the intimate relation is desirable. The desirable information source may be different depending on the method of control for the image forming apparatus. As for the possible information sources, there are the developing bias on-period for the red developing device, the toner supplying period from the red developing device hopper to the red developing device and the rotation period of the developing roller of the red developing device, for example. Instead of the rotation period of the developing roller, the amount of rotation or the rotation angle are usable. Where a sensor is provided to detect some information from the original to be printed, the black stripe can be controlled on the basis of the information indicative of the red portion of the original. More particularly, the information of the black stripe can be controlled on the basis of the information obtained by sampling each predetermined period during image formation a signal from the CCD or from the photodiode and adding the signal. It is simplest but possible that the black stripe is formed in response to a predetermined number of red copy. The detailed description will be made as to some of the above described.

First, the method of the black stripe formation on the basis of the red toner supplying period from the hopper to the red developing device and the amount of the supplied red toner, will be described. This method is advantageous in that it reflects the fact that the amount of the toner collected by the cleaner is different between when the image has a high density or high content of image and when the image has a low image density or a low content of image portion. Where the image transfer efficiency is constant, the amount of the toner collected by the cleaning device is strongly related with the amount of the toner supplied to the developing device. If the red developing device is equipped with a red toner supplying device in which the toner supply amount and the toner supply duration is substantially proportional, the simple signal indicative of the red toner supply period is usable to predict the amount of the toner collected by the cleaning device with high correlation. The red toner supply period can be obtained by integrating the red toner supply signal from an unshown ATR (automatic toner ratio controller) sensor provided in the red developing device. The flow chart in this control is essentially the same as that shown in FIG. 21, and the red developing device pressing period is replaced by the red toner supply period.

The description will be made as to the case where the magnetic toner is supplied to the cleaning device in response to the number of copies using the red toner, that is, the number of the image forming operations using the red (non-magnetic) toner.

Figure 22:
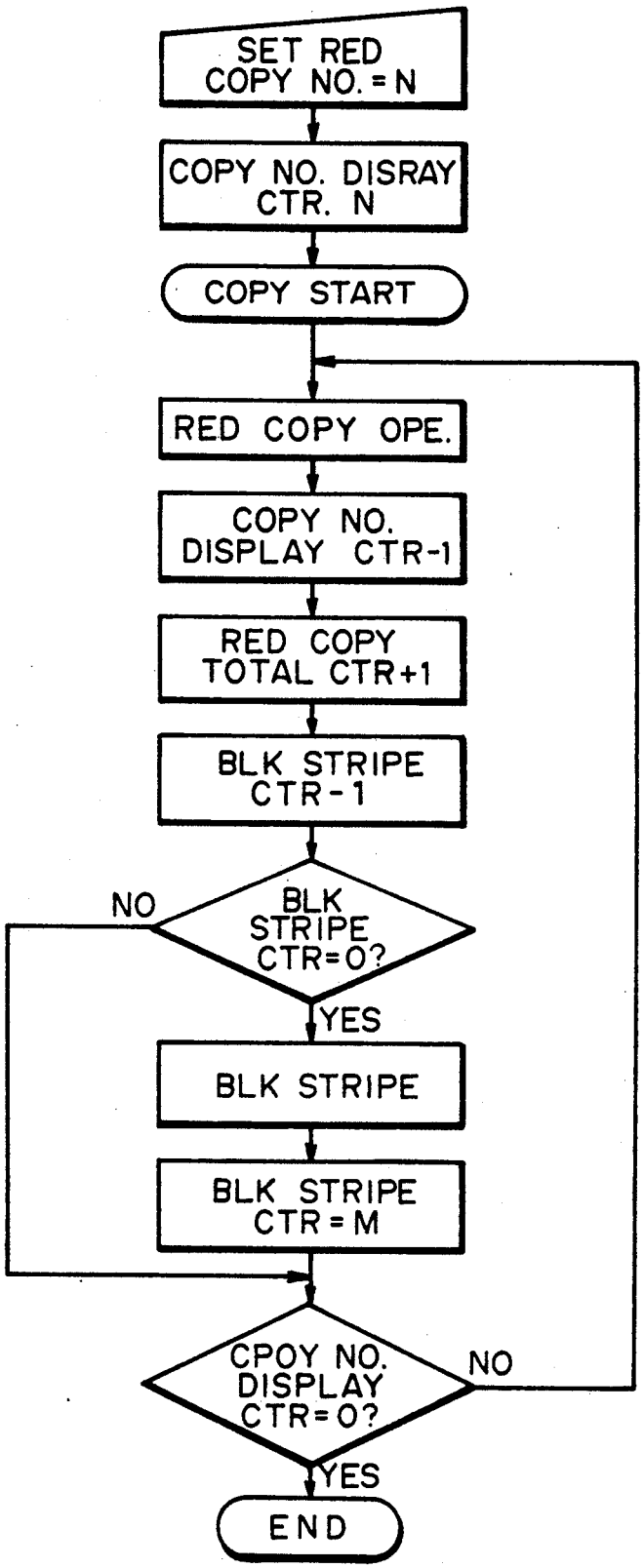

FIG. 22 shows a flow chart of control of this method. The number of copies or prints is set by the operator, and the number is displayed on the operation panel. After the operator confirms the number set, the copy button is depressed, by which the copying operation starts using the non-magnetic toner (red). The count N of the copy number display counter is reduced by one, that is, to N−1. The total counter of the red copy is added by +1. The black stripe counter is set beforehand to a predetermined count M, and it is reduced by one, that is, to M−1. Then, the discrimination is made as to whether the count of the black stripe counter is zero. If so, the operation for forming the black stripe is performed. If not, the discrimination is made as to whether the count of the copy number display is zero or not. If so, the copy operation is completed. If not, the copying operation is further continued. After the black stripe is formed, the black stripe counter is reset to the initial count M. Then, the discrimination is made again as to whether the count of the copy number display counter is 0 or not. If so, the copying operation is terminated, and if not, the operation is continued. With this operation, the sequential operation is accomplished to form the black stripe for every M copies produced with the non-magnetic toner.

The method of the black stripe formation and the timing of control therefore are as described hereinbefore. After the black stripe is produced, the second developing device is disengaged from the photosensitive drum 1, and then, the first developing device is conducted thereto, so that the copying operation with the non-magnetic (red) toner is resumed. In this manner, the magnetic toner can be supplied to the cleaning device in accordance with the number of copies produced using the non-magnetic toner.

In this example, the black stripe is formed only on the basis of the number of copies produced using the non-magnetic toner, independently of the copying operation using the magnetic toner. However, if the copying operation is performed with the magnetic toner, the cleaning device is necessarily supplied with more or less of the magnetic toner as the residual toner after the image transfer. From the standpoint of the running cost, the toner consumed for the formation of the black stripe is desirably smaller. Therefore in view of the actual situation wherein the copying operations with the magnetic toner and the non-magnetic toner are repeated at random, it is possible to reduce the consumption of the toner for the black stripe. This is accomplished on the basis of the same sequence wherein the black stripe is formed when M copies are produced with non-magnetic toner (red), and by modifying it by resetting the black stripe counter to restore it to M when x copies are produced with the magnetic toner during the copying operation using the non-magnetic toner.

Figure 23:
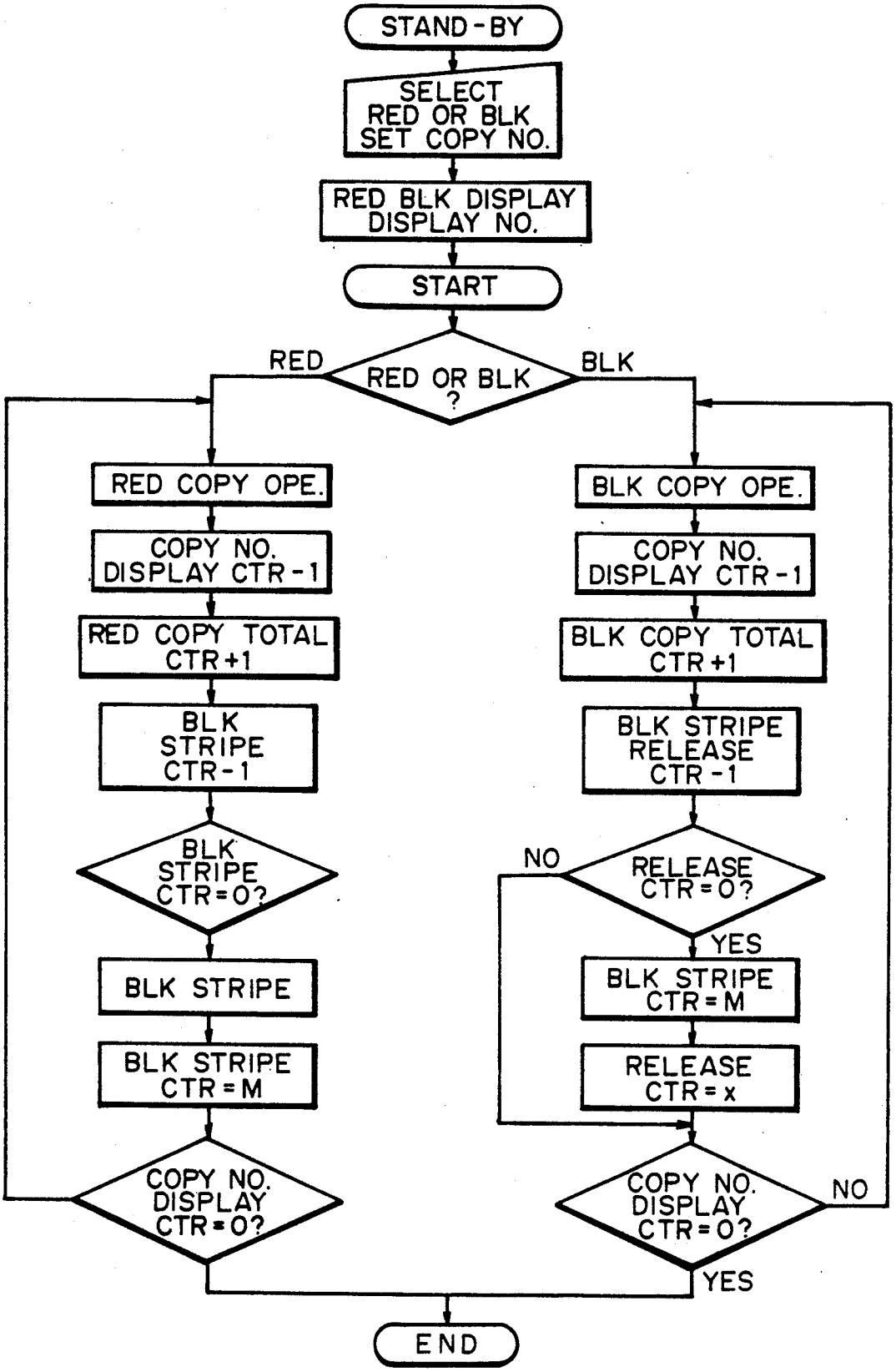

FIG. 23 shows a flow chart of this case. First, the operator determines whether a copy is produced in red or black, in response to which the operator depresses either red or black selection button. Also, the desired number of copies is set. By this, the operation panel displays the number of copies to be taken and the color selected. Upon depression of the start button, the apparatus discriminates whether the image formation is performed in black or red, and the copying operation is started. When the red copy is to be produced, the operation is the same as the foregoing embodiment. On the other hand, the black (magnetic) toner is used, a black stripe releasing or cancelling counter operates. For each of black copies, the count of the black stripe cancellation counter is reduced by one (initial count is x). When it reaches zero, the black stripe counter is returned to M. At this time, the black stripe cancellation counter is returned to the initial count x. When the copy number display counter becomes zero, the copying operation is terminated. When the black copy is produced after the red copy is produced, the black stripe counter is reset, and therefore, the black stripe is not formed unnecessarily.

However, even if the resetting operation is performed using the black stripe cancellation counter, the black stripe is formed unnecessarily.

It is possible to take into account the red/black ratio (non-magnetic toner/magnetic toner ratio) in the toner at the cleaning station.

Figure 24:
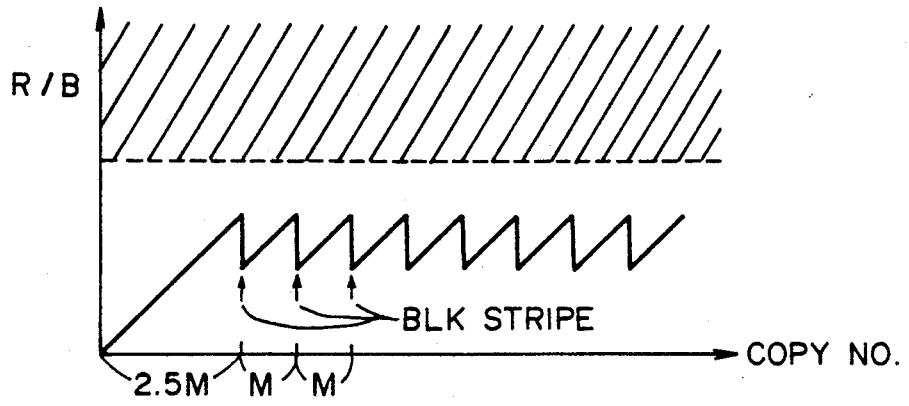
FIGS. 24 and 25 are graphs of red/black toner content ratio in the cleaning apparatus vs. number of copies produced in an image forming apparatus according to the present invention.

FIG. 24 illustrates this method, wherein the change of the red/black ratio of the toner on the magnet roller surface when the red copying operation is continued, when the black stripe is formed after 2.5 M copies, for every M copies. As will be understood, the formation of the black stripe reduces the red/black ratio, in the form of saw teeth. In this Figure, the hatched portion indicates the region wherein the red/black ratio is so large that the toner scatters and holds. The black stripe is formed so that the red/black ratio does not fall in this range. However, it is not usually necessary to form the black stripe before the first 2.5 M copies, since it is very rare for users to produce continuously 2.5 M or more red copies. Usually, a large number of black copy is produced thereafter. In view of this, it is not necessary to form the black stripe for the initial 2.5 M copies. To accomplish determination of the black stripe formation timing in view of the above in general, hypothetical red/black curve is prepared for the red-black ratio on the magnet roller surface in the cleaning device.

Figure 25:
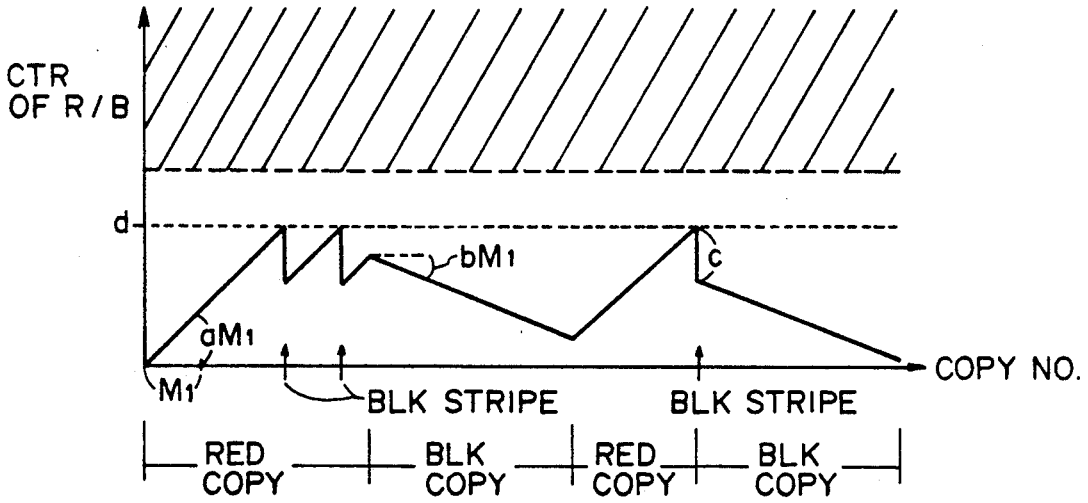

FIG. 25 shows this. The red/black ratio counter is added by +a for each of red copy productions, and it is reduced by b for each of black copy productions, and is reduced by c for each of the black stripe formations. The black stripe is formed when the red/black ratio counter reaches d or more. By this, when M1 red copies are produced, the count of the red/black ratio counter becomes aM1. When M1 black copies are produced, the count is reduced by bM1.

Figure 26:
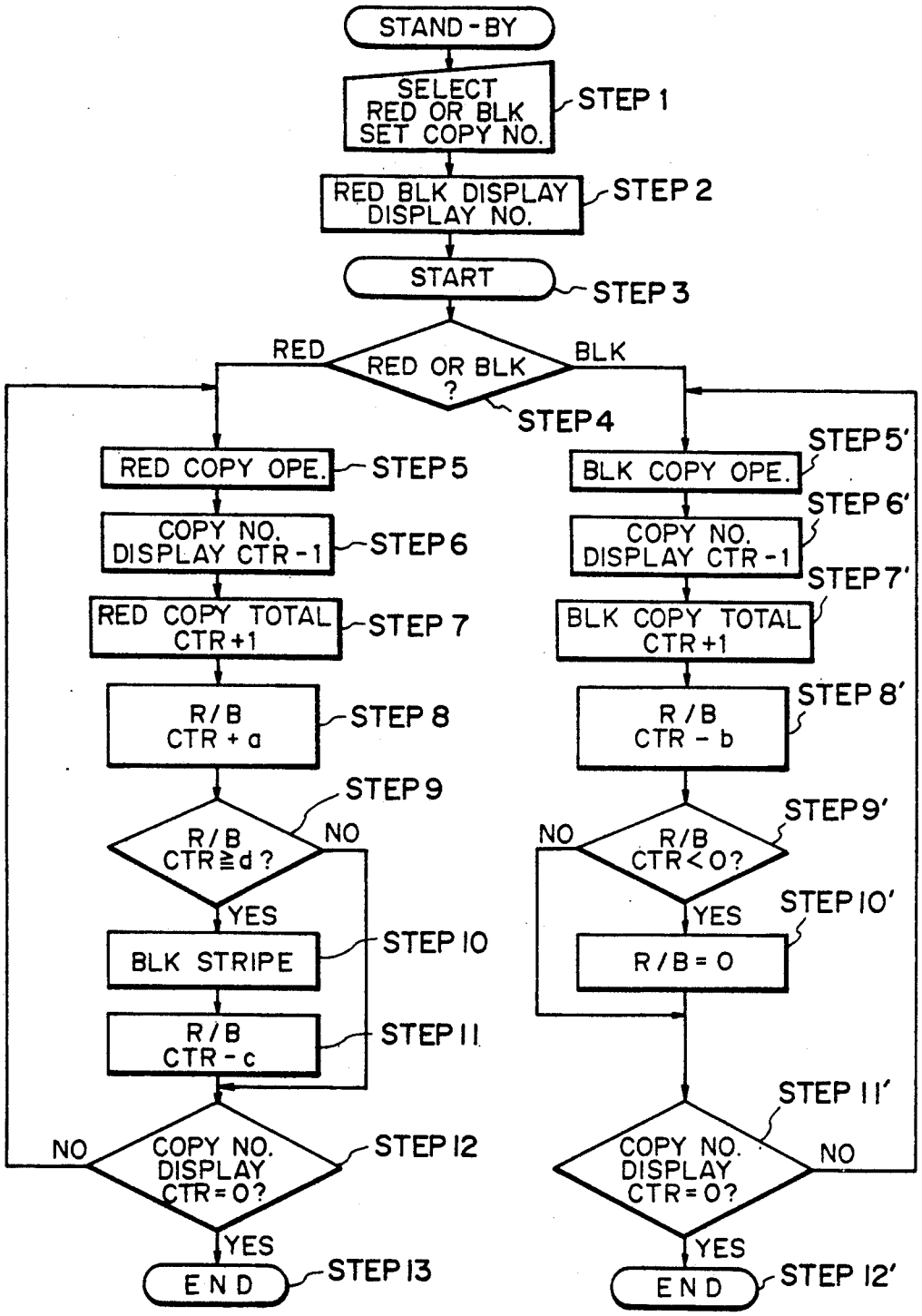

FIG. 26 shows the flow chart of this operation. When the operator selects the color (red or black) and sets the number of copies on the operation panel, and depresses the start key, the apparatus discriminates whether red or black is selected. If the red copy is selected, the red/black counter is added by +a, at step 8. Then, at step 9, the discrimination is made as to whether the count of the counter is equal to or larger than d. If so, the black stripe is formed. With the formation of the black stripe, the count is reduced by c, at step 11. If not, that is, the count is smaller than d at step 9, the steps 10 and 11 are omitted, while the copying operation is continued.

On the other hand, if the black copy is produced at step 8', the red/black ratio counter is reduced by b. The red/black ratio can not be negative, it is checked at step 9'. If it is negative, the copying operation is continued, while the red/black ratio is set to zero. If the black stripe is formed with the magnetic toner depending on the state of consumption of the magnetic toner, the wasteful consumption of the magnetic toner can be avoided.

The foregoing descriptions have been made with respect to the electrophotographic apparatus capable of forming a image in two colors, but the present invention is not limited to the two-color electrophotographic apparatus of the type shown in the Figures, but may be applicable to the two-color electrophotographic apparatus of the other types or to an image forming apparatus capable of three or more color images. The image exposure means for formation of the latent image may be in a form other than described above, for example, a liquid crystal shutter array or the like.

Instead of the magnet roller of the types above described, an elastic roller having magnetic field generating means therein or a roller on which fibers are planted or a non-magnetic sleeve having a magnet roller therein are usable.

Furthermore, the present invention is not limited to the cleaning device wherein the magnetic toner on the magnet roller brushes the surface of the image bearing member, but is applicable to a cleaning device wherein a magnet roller is provided as a magnetic toner collecting member below the cleaning blade and wherein the magnetic toner on the roller is spaced from the image bearing member. Where the non-magnetic toner is coagulated at the edge of the cleaning blade more easily than the magnetic toner, and therefore, insufficient cleaning occurs more easily, the present invention is applicable to the cleaning device not having the magnet roller.

Figure 5:
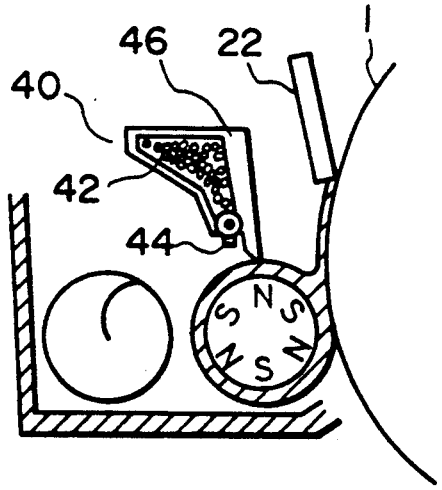

The supply of the magnetic particles to the cleaning means is not limited to by applying the magnetic toner by the developing device for the magnetic toner to the non-image area as described with the foregoing embodiments, but is applicable to the case where as shown in FIG. 5 the magnetic particle supplying means 40 is provided in the cleaning device 11. In this case, the magnetic particle supplying means 40 is provided with a supplying device 46 having a number of supply openings 44 formed along the longitudinal axis of the magnet roller 28, the supplying device 46 containing the magnetic particles. The supply of the magnetic particles is controlled by controlling the opening and closing of the supply openings 44 in accordance with the above-described sequence. The magnetic particles may be the magnetic toner particles, or other magnetic particles.

In the foregoing embodiments, the non-black color developer such as red developer is a two-component developer containing non-magnetic toner particles and magnetic carrier particles, but it may be a one component non-magnetic toner particles.

As described, the present invention is not limited to the embodiments described above, but includes combinations of the embodiments. As described in the foregoing, the image forming apparatus according to this embodiment, when the non-magnetic toner is used in the image formation, the magnetic particles are supplied to the cleaning means to prevent the non-magnetic toner from scattering in the cleaning device and leaking out of the container and contaminating the image forming apparatus.

In addition, according to the present invention, the residual material on the image bearing member can be almost completely removed, and therefore, the disturbance ("flow") attributable to the residual material under high humidity conditions can be prevented, thus maintaining the quality of the image.

Furthermore, according to the present invention, when the non-magnetic toner is used, the magnetic particles are applied to the non-image area in accordance with the amount of consumption of the non-magnetic toner, and therefore, the consumption of the magnetic particles can be minimized.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

latent image forming means for forming a latent image on said image bearing member;

developing means for developing the latent image formed on said image bearing member by said latent image forming means with non-magnetic toner;

transfer means for transferring an image developed by said developing means to a transfer means;

cleaning means for removing residual toner from said image bearing member after the image is transferred;

magnetic particle supplying means for supplying magnetic particles to said cleaning means, wherein when the non-magnetic toner is used for image formation by said image forming apparatus, said magnetic particle supplying means supplies the magnetic particles to said cleaning means in accordance with information relating to usage of the non-magnetic toner.

2. An apparatus according to claim 1, wherein said developing means further comprises magnetic toner developing means for developing the latent image on said image bearing member with magnetic toner, and wherein the magnetic toner developing means also functions as said magnetic particle supplying means.

3. An apparatus according to claim 1, wherein said cleaning means includes magnetic particle retaining means for retaining the magnetic particles.

4. An apparatus according to claim 3, wherein said magnetic particle retaining means is a rotatable member having a magnetic force.

5. An apparatus according to claim 2, wherein said magnetic toner developing means applies the magnetic toner to a non-image area of said image bearing member.

6. An apparatus according to claim 1, wherein said cleaning means includes a blade member in contact with said image bearing member at a position downstream of said magnetic particle retaining means with respect to a movement direction of said image bearing member.

7. An apparatus according to claim 1, wherein the information is an integrated time period in which said non-magnetic toner developing means is operated, and in accordance with the integrated amount, the supply of the magnetic particles by said magnetic particle supplying means is controlled.

8. An apparatus according to claim 1, wherein said image bearing member is a photosensitive member, and said latent image forming means includes means for exposing said photosensitive member to light.

9. An apparatus according to claim 8, wherein the information is an integrated time period in which the exposure means exposes the photosensitive member, and in accordance with the integrated amount, the supply of the magnetic particles by said magnetic particle supply means is controlled.

10. An apparatus according to claim 8, wherein the information is a position of exposure of said latent image bearing member by said exposure means for latent image formation, and in accordance with the exposure position, the supply of the magnetic particles by said magnetic particle supply means is controlled.

11. An apparatus according to claim 8, wherein the information contains an integrated time period in which said photosensitive member is exposed by said exposure means for latent image formation and a position of exposure of said photosensitive member by said exposure means, and in accordance with the integrated amount and the exposure position, the supply of the magnetic particles by said magnetic particle supplying means is controlled.

12. An apparatus according to claim 3, wherein the magnetic particles retained by said magnetic particle retaining means are contacted to said image bearing member.

13. An apparatus according to claim 8, wherein Said exposure means exposes said photosensitive member to light which is produced by an electrical signal indicative of image information.

14. An apparatus according to claim 13, wherein said exposure means projects a laser beam onto said image bearing member.

15. An apparatus according to claim 5, wherein when said apparatus carries out continuously its image forming operation, the magnetic particles are applied to a non-image area of said image bearing member between adjacent image areas by said magnetic toner developing means.

16. An apparatus according to claim 5, wherein said magnetic toner developing means applies the magnetic toner to a non-image area following an image area of said image bearing member after an image forming operation of said apparatus.

17. An apparatus according to claim 1, wherein said non-magnetic toner is a chromatic toner.

18. An apparatus according to claim 2, wherein said magnetic toner is a black toner.

19. An apparatus according to claim 5, wherein said magnetic toner developing means stops supply of the magnetic toner to said non-image area of said image bearing member when said magnetic toner developing means consumes the magnetic toner for image formation, in accordance with information relating to usage of the magnetic toner.

20. An apparatus according to claim 19, wherein said image bearing member is a photosensitive member, and said latent image forming means includes means for exposing said photosensitive member to light.

21. An apparatus according to claim 8 or 20, wherein said photosensitive member is an amorphous silicon photosensitive member.

22. An apparatus according to claim 5, wherein the non-image area of said image bearing member is an area where it does not contact the transfer material.

23. An apparatus according to claim 6, wherein said blade member removes the non-magnetic toner, and said magnetic particle retaining means is movable to convey the non-magnetic toner removed by said blade member.

24. An image forming apparatus, comprising:

a movable image bearing member;

latent image forming means for forming a latent image on said image bearing member;

developing means for developing the latent image formed on said image bearing member by said latent image forming means with non-magnetic toner;

transfer means for transferring an image developed by said developing means to a transfer material;

cleaning means for removing residual toner from said image bearing member after the image is transferred, wherein said cleaning means includes magnetic particle retaining means for retaining magnetic particles; and magnetic particle supplying means for supplying the magnetic particles to said magnetic particle retaining means of said cleaning means without using said image bearing member.

25. An apparatus according to claim 24, wherein said cleaning means and said magnetic particle supplying means constitute a cleaning unit.

26. An apparatus according to claim 24, wherein said cleaning means includes a blade member contacted to said image bearing member at a position downstream of said magnetic particle retaining means with respect to the movement direction of said image bearing member.

27. An apparatus according to claim 24, wherein the magnetic particles retained by said magnetic particle retaining means are contacted to said image bearing member.

28. An apparatus according to claim 24, wherein said image bearing member is a photosensitive member, and said latent image forming means includes means for exposing said photosensitive member to light.

29. An apparatus according to claim 28, wherein said photosensitive member is an amorphous silicon photosensitive member.

30. An apparatus according to claim 26, wherein said blade member removes the non-magnetic toner, and said magnetic particle retaining means is movable to convey the non-magnetic toner removed by said blade member.

31. An image forming apparatus, comprising:

a movable image bearing member;

latent image forming means for forming a latent image on said image bearing member;

first developing means for developing the latent image formed on said image bearing member by said latent image forming means with non-magnetic toner;

second developing means for developing the latent image formed on said image bearing member by said latent image forming means with magnetic toner;

transfer means for transferring an image developed by said developing means to transfer material; and a cleaning device for removing residual magnetic and non-magnetic toner from said image bearing member after the image is transferred, wherein said cleaning device includes a cleaning member which contacts said image bearing member to remove the non-magnetic toner and movable magnetic toner retaining means for conveying and retaining the magnetic toner by magnetic force.

32. An apparatus according to claim 31, wherein said magnetic toner retaining means is a rotatable member providing magnetic force.

33. An apparatus according to claim 31, wherein said cleaning member is in the form of a blade, and is disposed downstream of said magnetic toner retaining means with respect to the movement direction of said image bearing member.

34. An apparatus according to claim 31, wherein said image bearing member is a photosensitive member, and said latent image forming means includes means for exposing said photosensitive member to light.

35. An apparatus according to claim 31, wherein the magnetic toner retained by said retaining means contacts said image bearing member.

36. An apparatus according to claim 34, wherein said exposure means exposes said photosensitive member to light which is produced by an electrical signal indicative of image information.

37. An apparatus according to claim 36, wherein said exposure means projects a laser beam onto said image bearing member.

38. An apparatus according to claim 31, wherein when said apparatus carries out continuously its image forming operation, the magnetic toner are applied to a non-image area of said image bearing member between adjacent image areas by said magnetic toner developing means.

39. An apparatus according to claim 31, wherein said developing means applies the magnetic toner to a non-image area following an image area of said image bearing member after an image forming operation of said apparatus.

40. An apparatus according to claim 31, wherein said non-magnetic toner is a chromatic toner.

41. An apparatus according to claim 31, wherein said magnetic toner is a black toner.

42. An apparatus according to claim 34, wherein said photosensitive member is an amorphous silicon photosensitive member.

43. An apparatus according to claim 31, wherein the non-image area of said image bearing member is an area where it does not contact the transfer material.

* * * * *

UNITED STATES PATENT AND TRADEMARK OFFICE

CERTIFICATE OF CORRECTION

PATENT NO. : 5,027,161 Page 1 of 4

DATED : June 25, 1991

INVENTOR(S) : Nobuyuki KUME, ET AL.

It is certified that error appears in the above-identified patent and that said Letters Patent is hereby corrected as shown below:

On the title page:

AT [57] Abstract:

"magnetic paricle" should read --a magnetic particle--.

Sheet 16

Figure 22, "CPOY" should read --COPY--.

COLUMN 1

Line 67, "two color" should read --two-color--.

COLUMN 2

Line 37, "cross sectional" should read --cross-sectional--.
Line 38, "two color" should read --two-color--.
Line 46, "member each" should read -- member at each--.
Line 55, "cross sectional" should read --cross-sectional--.
Line 56, "two color" should read --two-color--.

UNITED STATES PATENT AND TRADEMARK OFFICE

CERTIFICATE OF CORRECTION

PATENT NO. : 5,027,161 Page 2 of 4

DATED : June 25, 1991

INVENTOR(S) : Nobuyuki KUME, ET AL.

It is certified that error appears in the above-identified patent and that said Letters Patent is hereby corrected as shown below:

COLUMN 3

Line 16, "sectional" should read --cross-sectional--.
Line 33, delete "&0".
Line 56, "imagewisely" should read --imagewise--.

COLUMN 4

Line 17, "second charges 5" should read --second charger 5--.
Line 28, "one component" should read --one-componet--.
Line 37, "Next" should read --Next, --.

COLUMN 7

Line 29, "signal (BD) A/10" should read --signal (BD) A-10--.
Line 44, "paper" should read --paper,--.
Line 45, "257x210 picture elements" should read --297x 210 picture elements--.
Line 63, "solution" should read --resolution--.

COLUMN 8

Line 13, "FIG. 12(a)" should read --FIG. 12(a))--.
Line 49, "$D_{16}$=123H, $D_8$32 9 H." should read --$D_{16}$= 123H, $D_8$ = 9H.--.
Line 52, "tionally. In" should read --tionally, in--.

UNITED STATES PATENT AND TRADEMARK OFFICE

CERTIFICATE OF CORRECTION

PATENT NO. : 5,027,161 Page 3 of 4

DATED : June 25, 1991

INVENTOR(S) : Nobuyuki KUME, ET AL.

It is certified that error appears in the above-identified patent and that said Letters Patent is hereby corrected as shown below:

COLUMN 9

Line 55, "continuously. After" should read --continuously, after--.

COLUMN 11

Line 17, "exposure means 3" should read --exposure means 3A--.

Line 46, "tacted o" should read --tacted with or--.

COLUMN 12

Line 67, "(3p) if" should read --(3p); if--.

COLUMN 14

Line 36, "conducted" should read --connected--.

COLUMN 16

Line 7, "a" should read --an--.

Line 53, "one compo-" should read --one-compo- --.

COLUMN 17

Line 25, "transfer means" should read --transfer material;--.

UNITED STATES PATENT AND TRADEMARK OFFICE

CERTIFICATE OF CORRECTION

PATENT NO. : 5,027,161 Page 4 of 4

DATED : June 25, 1991

INVENTOR(S) : Nobuyuki KUME, ET AL.

It is certified that error appears in the above-identified patent and that said Letters Patent is hereby corrected as shown below:

COLUMN 18

Line 6, "supply" should read --supplying--.

Line 12, "supply" should read --supplying--.

Line 26, "Said" should read --said--.

Line 56, "claim 19," should read --claim 7,--.

COLUMN 20

Line 37, "are" should read --is--.

Signed and Sealed this

Seventeenth Day of November, 1992

*Attest:*

DOUGLAS B. COMER

*Attesting Officer*

*Acting Commissioner of Patents and Trademarks*